US008151608B2

(12) United States Patent
Fisher et al.

(10) Patent No.: US 8,151,608 B2
(45) Date of Patent: Apr. 10, 2012

(54) ELECTRONIC LOCK BOX WITH MECHANISM IMMOBILIZER FEATURES

(75) Inventors: Scott R. Fisher, West Chester, OH (US); Matthew K. Caskey, Loveland, OH (US); John P. Crutcher, Cincinnati, OH (US); Robin S. Glassburn, Batavia, OH (US); Wendell H. Morris, Cincinnati, OH (US)

(73) Assignee: SentriLock, LLC, Cincinnati, OH (US)

( * ) Notice: Subject to any disclaimer, the term of this patent is extended or adjusted under 35 U.S.C. 154(b) by 929 days.

(21) Appl. No.: 12/128,038

(22) Filed: May 28, 2008

(65) Prior Publication Data

US 2009/0293562 A1 Dec. 3, 2009

(51) Int. Cl.
*E05B 49/00* (2006.01)

(52) U.S. Cl. ..... 70/278.7; 70/24; 70/63; 70/278.1; 70/DIG. 63

(58) Field of Classification Search ..... 70/22, 24, 70/38 A, 39, 54–56, 63, 277, 278.1, 278.7, 70/DIG. 63

See application file for complete search history.

(56) References Cited

U.S. PATENT DOCUMENTS

| | | | |
|---|---|---|---|
| 2,460,615 | A | 2/1949 | Andrew |
| 3,889,501 | A | 6/1975 | Fort |
| 4,148,092 | A | 4/1979 | Martin |
| 4,532,783 | A | 8/1985 | Maurice |
| 4,556,872 | A | 12/1985 | Masoncup et al. |
| 4,609,780 | A | 9/1986 | Clark |
| 4,727,368 | A | 2/1988 | Larson et al. |
| 4,766,746 | A | 8/1988 | Henderson et al. |
| 4,808,993 | A | 2/1989 | Clark |
| 4,831,851 | A | 5/1989 | Larson |
| 4,838,052 | A | 6/1989 | Williams et al. |
| 4,851,652 | A | 7/1989 | Imran |
| 4,864,115 | A | 9/1989 | Imran et al. |
| 4,881,387 | A | 11/1989 | Kortenbrede |
| 4,887,292 | A | 12/1989 | Barrett et al. |
| 4,896,246 | A | 1/1990 | Henderson et al. |
| 4,901,545 | A | 2/1990 | Bacon et al. |
| 4,914,732 | A | 4/1990 | Henderson et al. |
| 4,916,443 | A | 4/1990 | Barrett et al. |
| 4,929,880 | A | 5/1990 | Henderson et al. |
| 4,947,163 | A | 8/1990 | Henderson et al. |
| 4,967,305 | A | 10/1990 | Murrer et al. |
| 4,988,987 | A | 1/1991 | Barrett et al. |

(Continued)

OTHER PUBLICATIONS

PCT International Search Report, PCT/US2009/030240, 13 pages (Mar. 9, 2009).

(Continued)

*Primary Examiner* — Suzanne Barrett
*Assistant Examiner* — Christopher Boswell
(74) *Attorney, Agent, or Firm* — Frederick H. Gribbell

(57) ABSTRACT

An electronic lock box contains a mechanical structure that allows the lock box to work in several different mechanical states. A first state is a key compartment door unlocking state, while a second state is a shackle release state. A third state is a "soft lock" state, which allows the key compartment door to be closed, or the shackle to be re-installed, and once this has occurred, the door will not fall open, and the shackle will not fall out. A fourth state is a "hard lock" state in which the key compartment door and the shackle are not easily disturbed by vibration or intentional impact by a would-be thief, who is attempting to unlawfully open the door or remove the shackle.

20 Claims, 15 Drawing Sheets

U.S. PATENT DOCUMENTS

| | | | | |
|---|---|---|---|---|
| 5,046,084 | A | | 9/1991 | Barrett et al. |
| 5,090,222 | A | | 2/1992 | Imran |
| 5,245,652 | A | | 9/1993 | Larson et al. |
| 5,280,518 | A | | 1/1994 | Danler et al. |
| 5,460,020 | A | | 10/1995 | Hungerford |
| 5,475,375 | A | | 12/1995 | Barrett et al. |
| 5,511,832 | A | | 4/1996 | Künzel |
| 5,550,529 | A | | 8/1996 | Burge |
| 5,602,536 | A | | 2/1997 | Henderson et al. |
| 5,654,696 | A | | 8/1997 | Barrett et al. |
| 5,705,991 | A | | 1/1998 | Kniffin et al. |
| 5,758,522 | A | * | 6/1998 | York ..... 70/63 |
| 5,768,921 | A | | 6/1998 | Hill |
| 5,791,172 | A | | 8/1998 | Deighton et al. |
| 5,794,465 | A | | 8/1998 | Hill |
| 5,815,557 | A | | 9/1998 | Larson |
| 6,046,558 | A | | 4/2000 | Larson et al. |
| 6,047,575 | A | | 4/2000 | Larson et al. |
| 6,072,402 | A | | 6/2000 | Kniffin et al. |
| 6,304,003 | B1 | | 10/2001 | Rathmann et al. |
| 6,434,987 | B1 | | 8/2002 | Juillerat et al. |
| 6,766,673 | B2 | | 7/2004 | Gast et al. |
| 7,009,489 | B2 | * | 3/2006 | Fisher ..... 340/5.7 |
| 7,086,258 | B2 | | 8/2006 | Fisher et al. |
| 7,193,503 | B2 | * | 3/2007 | Fisher ..... 340/5.73 |
| 7,251,967 | B2 | * | 8/2007 | Yang ..... 70/63 |
| 7,420,456 | B2 | * | 9/2008 | Fisher ..... 340/5.73 |
| 2004/0226325 | A1 | | 11/2004 | Ling |

OTHER PUBLICATIONS

PCT Informal Comments, PCT/US2009/030240, 8 pages (Jun. 15, 2009).

Advertising brochures of MULTACC Corporation, 16 pages (admitted prior art).

Advertising brochures of Supra Products, Inc., 8 pages (1982).

Advertising brochures of Supra Products, Inc., 2 pages (Nov. 29, 2001).

* cited by examiner

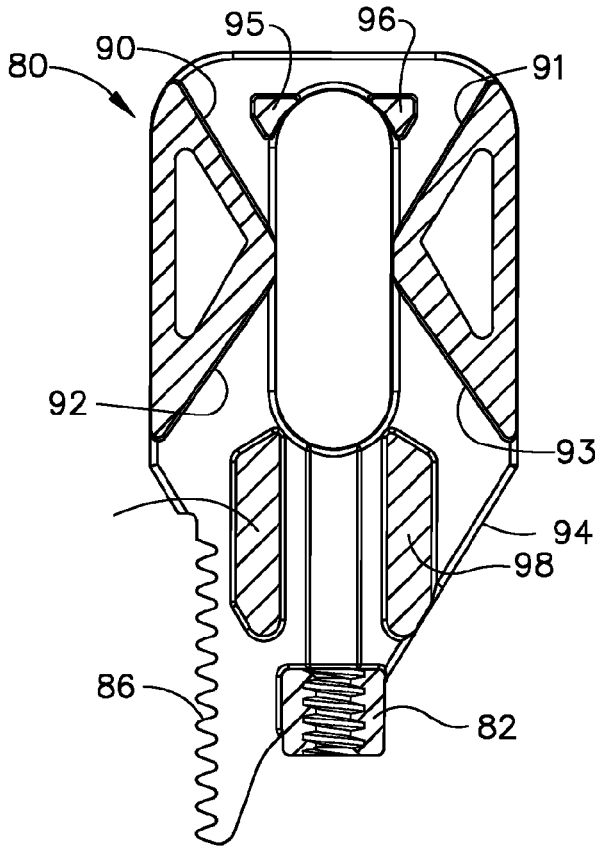
FIG.10
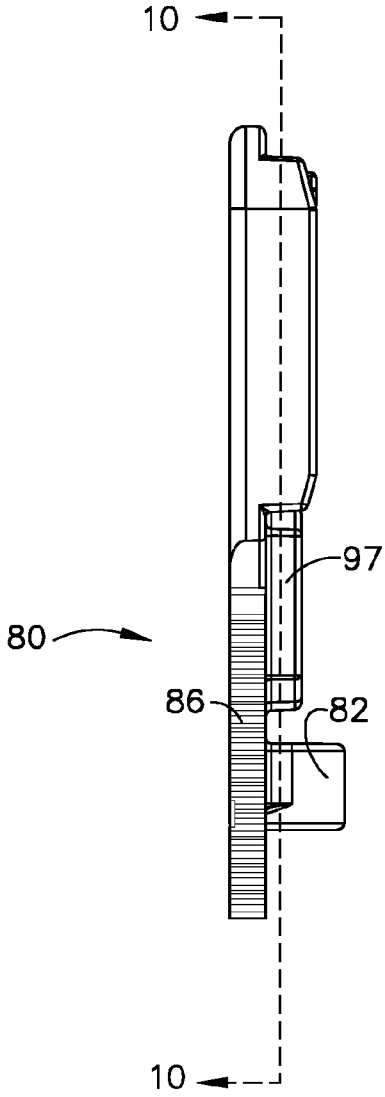
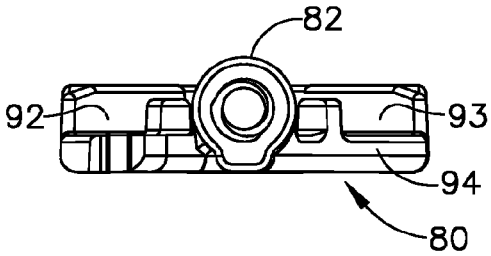
FIG.11
FIG.12

ELECTRONIC LOCK BOX WITH MECHANISM IMMOBILIZER FEATURES

BACKGROUND OF THE INVENTION

1. Field of the Invention

The present invention relates generally to electronic lock equipment and is particularly directed to an electronic lock box of the type that contains a secure compartment for storing keys that allow entry to a structure. The invention is specifically disclosed as an electronic lock box that includes an internal movable actuator that moves in one direction to open the door to a secure compartment containing a key to the structure, and moves in the opposite direction to release a shackle that holds the lock box to the structure, such as a door handle. Much of the theory of operation of a similar movable actuator is disclosed in U.S. Pat. No. 7,086,258, by the same inventor.

In the present invention, improvements are made to the previous cost efficient design, including a more secure mechanical actuator and locking mechanisms. In addition, the present invention maximizes the "power budget" for operating the secure actuator mechanisms.

2. Description of the Related Art

In U.S. Pat. No. 7,086,258, a prime mover apparatus moves a movable actuator which engages latches that retain either a key compartment door or a shackle for attaching the lockbox to a fixed object. The prime mover typically is a high performance micro-motor with a spur gear attached which interfaces with a set of "rack" teeth that translate the rotational energy of the motor shaft into linear motion. This cost efficient design works well, however, improvements can be made.

Lockboxes require increasing levels of security as the homes they protect have increasingly valuable contents. Thieves may try multiple means at their disposal to gain entry into a lockbox so a robust latching system to thwart the would-be attacker would be a decided improvement.

SUMMARY OF THE INVENTION

Accordingly, it is an advantage of the present invention to provide an improved movable actuator design that increases the mechanical security of the device.

It is another advantage of the present invention to provide an improved movable actuator design for an electronic lock box that increases its reliability.

It is a further advantage of the present invention to provide an improved electronic lock box design that improves the economic use of battery power for driving the actuator motor.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, a locking apparatus is provided, which comprises: (a) a movable actuator that travels in a substantially linear direction between a first end travel position and a second end travel position, the movable actuator having a first end and a second end and a central area therebetween, and the movable actuator having a longitudinal axis which runs between the first and second ends; (i) the movable actuator having a first spaced-apart pair of sloped surfaces that, proximal to the first end, are farther apart from one another, and that, at the central area, are closer to one another, wherein the first pair of sloped surfaces are at angles that are not perpendicular to the longitudinal axis; (ii) the movable actuator having a second spaced-apart pair of sloped surfaces that, proximal to the second end, are farther apart from one another, and that, at the central area, are closer to one another, wherein the second pair of sloped surfaces are at angles that are not perpendicular to the longitudinal axis; (iii) the movable actuator having a first spaced-apart pair of blocking members that are located proximal to the first end, and which are spaced apart from the first pair of sloped surfaces; (iv) the movable actuator having a second spaced-apart pair of blocking members that are located proximal to the second end, and which are spaced apart from the second pair of sloped surfaces; (b) a transverse first control arm that exhibits a first control protrusion, a transverse second control arm that exhibits a second control protrusion, and a first mechanical bias member that tends to push the first and second control arms apart from one another; (c) a transverse third control arm that exhibits a third control protrusion, a transverse fourth control arm that exhibits a fourth control protrusion, and a second mechanical bias member that tends to push the third and fourth control arms apart from one another; (d) a housing that holds the first control arm, the second control arm, the third control arm, the fourth control arm, and the movable actuator in their proper physical orientations with respect to one another; (e) wherein: (i) when the movable actuator is at a first position of its travel, the first control protrusion and the second control protrusion make contact with the first pair of sloped surfaces which cause the first and second control protrusions to move inward, thereby retracting the first and second control arms, and allowing a first mechanical member to be unlocked; (ii) when the movable actuator is at a second position of its travel, the third control protrusion and the fourth control protrusion make contact with the second pair of sloped surfaces which cause the third and fourth control protrusions to move inward, thereby retracting the third and fourth control arms, and allowing a second mechanical member to be unlocked; (iii) when the movable actuator is at a third position of its travel, the first control protrusion and the second control protrusion do not make contact with the first pair of sloped surfaces which allow the first and second control arms to extend outward, and causing the first mechanical member to be locked; and (iv) when the movable actuator is at the third position of its travel, the third control protrusion and the fourth control protrusion do not make contact with the second pair of sloped surfaces which allow the third and fourth control arms to extend outward, and causing the second mechanical member to be locked.

In accordance with another aspect of the present invention, a lock box apparatus is provided, which comprises: an enclosure; a detachable holding member actuatable by a first movable control arm; a secure compartment within the enclosure, having a movable door actuatable by a second movable control arm; a movable actuator; and a driving member that causes the movable actuator to move along a substantially linear travel pathway between a first end travel position and a second end travel position; wherein: (a) the first movable control arm includes a first control protrusion that, in first predetermined conditions, makes contact with a first control surface of the movable actuator; (b) the second movable control arm includes a second control protrusion, in second predetermined conditions, makes contact with a second control surface of the movable actuator; (c) the movable actuator includes a first blocking member, which may engage the first control protrusion; (d) the movable actuator includes a second blocking member, which may engage the second control protrusion; (e) when moved to a first position along the substantially linear travel pathway, the movable actuator causes the first movable control arm to be actuated, by way of contact between the first control protrusion and the first control surface, so as to release the holding member, thus allowing the lock box apparatus to be detached from a fixed object; (f) when moved to a second position along the substantially linear travel pathway, the movable actuator causes the second movable control arm to be actuated, by way of contact between the second control protrusion and the second control surface, so as to disengage the door, thus allowing access to the secure compartment by opening the door; (g) when moved to a third position along the substantially linear travel pathway, the movable actuator causes the first movable control arm to be actuated so as to allow the holding member to be reinstalled to the lock box apparatus, and once the holding member has been reinstalled, the first movable control arm prevents the holding member from falling out from the lock box apparatus, thereby obtaining a "soft lock;" (h) when moved to the third position along the substantially linear travel pathway, the movable actuator causes the second movable control arm to be actuated so as to allow the door to be closed, and once the door has been closed, the second movable control arm prevents the door from falling open, thereby obtaining a "soft lock;" (i) when the movable actuator is moved to a fourth position along the substantially linear travel pathway, the first control surface of the movable actuator and the first blocking member substantially hold the first control protrusion within a first predetermined range of movement, and thus prevent the holding member from being detached from the lock box apparatus, thereby obtaining a "hard lock;" and (j) when the movable actuator is moved to the fourth position along the substantially linear travel pathway, the second control surface of the movable actuator and the second blocking member substantially hold the second control protrusion within a second predetermined range of movement, and thus prevent the door from being opened, thereby obtaining a "hard lock."

In accordance with a further aspect of the present invention, a method for using a lock box is provided, in which the method comprises the following steps: (a) providing a lock box apparatus that includes an enclosure; a detachable shackle actuatable by a first movable control arm; a secure compartment within the enclosure, having a movable door actuatable by a second movable control arm; a movable actuator having first and second control surfaces; and a driving member that causes the movable actuator to move along a substantially linear travel pathway between a first end travel position and a second end travel position; (b) driving the movable actuator to a first predetermined position such that the first control surface of the movable actuator causes movement of the first movable control arm so as to release the shackle; (c) driving the movable actuator to a second predetermined position such that the second control surface of the movable actuator causes movement of the second movable control arm so as to allow the door to be opened; (d) driving the movable actuator to a third predetermined position creating a "soft lock" state, such that: (i) the first movable control arm is positioned to allow the shackle to be reinstalled, and to prevent the shackle from falling out from the enclosure, and (ii) the second movable control arm is positioned to allow the door to be closed, and to prevent the door from being reopened; and (e) driving the movable actuator to a fourth predetermined position creating a "hard lock" state, such that: (i) the first control surface of the movable actuator and a first blocking member of the movable actuator combine to limit movement of the first movable control arm, such that the shackle cannot be released, and (ii) the second control surface of the movable actuator and a second blocking member of the movable actuator combine to limit movement of the second movable control arm, such that the door cannot be opened.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The above-mentioned and other features and advantages of this invention, and the manner of attaining them, will become more apparent and the invention will be better understood by reference to the following description of at least one embodiment of the invention taken in conjunction with the accompanying drawings. The accompanying drawings incorporated in and forming a part of the specification illustrate several aspects of the present invention, and together with the description and claims serve to explain the principles of the invention. In the drawings:

FIG. 10 is a front elevational view in cross-section of the movable actuator of FIG. 8, taken along the lines 10-10 of FIG. 8.

FIG. 11 is a bottom plan view of the movable actuator of FIG. 8.

FIG. 12 is a side elevational view of the movable actuator of FIG. 8.

DETAILED DESCRIPTION OF THE INVENTION

Figure 1:
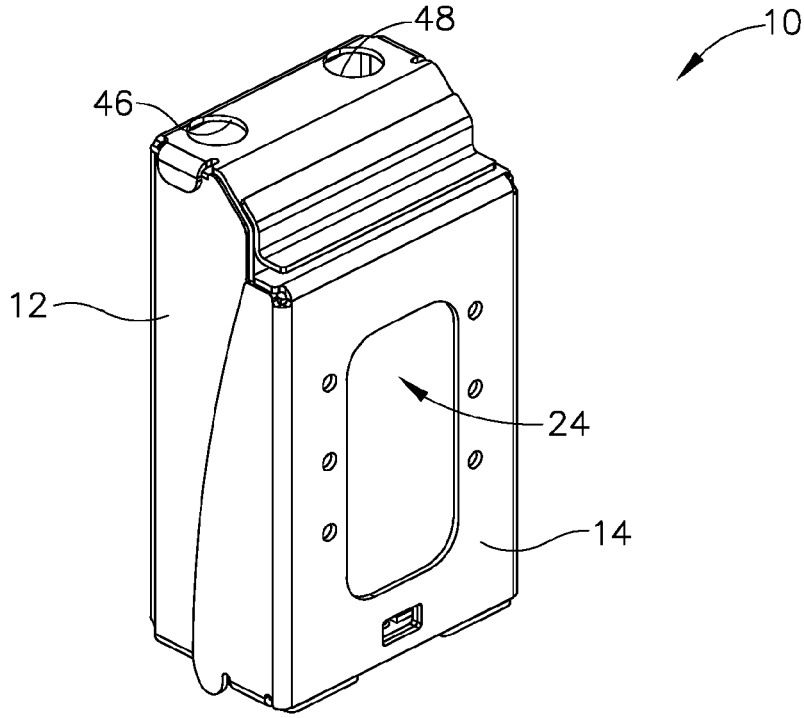
FIG. 1 is a perspective view of the outer enclosure of an electronic lock box, as constructed according to the principles of the present invention.

Reference will now be made in detail to the present preferred embodiment of the invention, an example of which is illustrated in the accompanying drawings, wherein like numerals indicate the same elements throughout the views. The exemplifications set out herein illustrate at least one preferred embodiment of the invention, in at least one form, and such exemplifications are not to be construed as limiting the scope of the invention in any manner.

The terms "first" and "second" preceding an element name, e.g., first control arm, second control arm, etc., are used for identification purposes to distinguish between similar or related elements, results or concepts, and are not intended to necessarily imply order, nor are the terms "first" and "second" intended to preclude the inclusion of additional similar or related elements, results or concepts, unless otherwise indicated.

The present invention provides a level of protection not found in any existing lock box design. Physical testing has shown that simple opposed latch designs used in other products are vulnerable to attack with simple hand tools such as hammers. Other designs have incorporated improvements such as opposing latches to improve security from impacts, however, none to date has incorporated a two-state locking system whereby, in the first state the latches utilized can be deflected with the normal operation of closing the door or inserting the shackle, and the second state immobilizes the latches such that external forces applied to the device restrict the latch movement, thereby significantly increasing attack resilience. The two-state locking system of the present invention provides maximum usability and security without a significant increase in cost.

Additional resistance to the unwanted application of external forces can be found in the present invention, by use of a drive screw to couple power from the motor gear box to the movable actuator. As illustrated below, a retention collar in the drive screw prevents the coupled drive assembly from being forced by external linear pressure in a direction where undesired latch movement otherwise would result.

The benefits of these improvements are greater protection against unwanted intrusion through: (a) hammer blows applied perpendicular to the axis of latch travel; (b) deflection of latches by first drilling a hole in the lockbox outer casing, and subsequent insertion of a screwdriver or other tool to force the latches inward and to release the retained shackle or key door; or (c) device impacts induced through sudden deceleration such as the lockbox being thrown against a hard surface.

Another advantage of the invention is the actuation force created through the arrangement of a micro-motor with gear box and the Acme drive screw. Electronic lockbox designs require great attention to power consumption as all are battery operated. Electronic lock boxes are also subject to extreme cold found in northern climates. Such extreme cold limits the instantaneous power available from the battery supply. The Acme drive screw increases the drive ratio between the rotational speed of the micro-motor and the imparted physical movement of the latching system while minimizing frictional losses in the drive screw. A high drive ratio requires less current to operate at any given point in time making it ideally suited for situations where battery current is limited by temperature. This allows the lock box of the present invention to operate very close to the chemical reaction limits posed by the battery chemistry. Some of the other electronic lockboxes now in use utilize solenoids that have poor power consumption characteristics.

Referring now to FIG. 1, an overall view of the outer casing of the electronic lock box is illustrated, in which the lock box is generally designated by the reference numeral 10. The outer enclosure is hinged, and has a stationary rear case 12 and a movable (via the hinge) front case 14. There is an opening 24 in the front case for a keypad (not shown), by which a user can enter commands and other information to the electronic controller of the electronic lock box 10.

Figure 2:
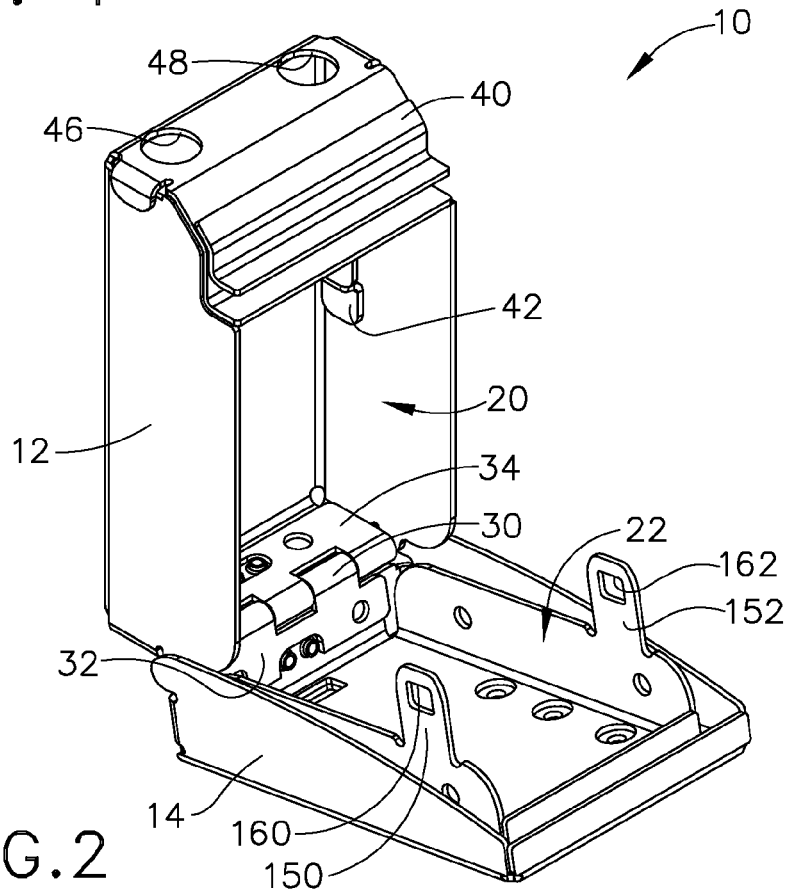
FIG. 2 is a perspective view of the electronic lock box of FIG. 1, in which the key compartment door is in its open state.

FIG. 2 illustrates the electronic lock box 10 in the condition in which the front case 14 has been opened, and has been pivoted with respect to the rear case 12. A hinge pin 30 can be seen, as well as the front case hinge leaf 32, and the rear case hinge leaf 34. An open space or volume 20 is made available to hold the mechanical components that will be described below, and this set of mechanical components is essentially to be affixed to the rear case 12. There is also an open space or volume 22 that is made available for holding a mechanical key, or other important component or device that is to be retained within the electronic lock box. This is also sometimes referred to as the "key compartment" or the "secure compartment." In FIG. 2, the secure compartment 22 is not illustrated in detail, as any type of relatively small container size and shape would suffice for holding a mechanical house key, or some other type of credit card-sized device that would hold building opening or access codes, for example.

FIG. 2 also shows a pair of catching members 150 and 152, which are used to hold the front case 14 closed against the rear case 12. The first catching member 150 has an opening 160, and the second catching member 152 has an opening 162. These openings 160 and 162 will receive a spring-loaded movable member that, once in place within the openings 160 and 162, will prevent the key compartment 22 from being exposed (i.e., the key compartment "door" will remain closed). The spring-loaded movable members are discussed below, in reference to FIGS. 16, 17, and 23-26.

FIGS. 1 and 2 also illustrate openings for allowing a shackle to be inserted along the top surface of the electronic lock box 10. These shackle openings are at 46 and 48, and the "barrels" of the shackle are inserted here. The shackle itself is not illustrated in these views, for the sake of clarity.

Figure 3:
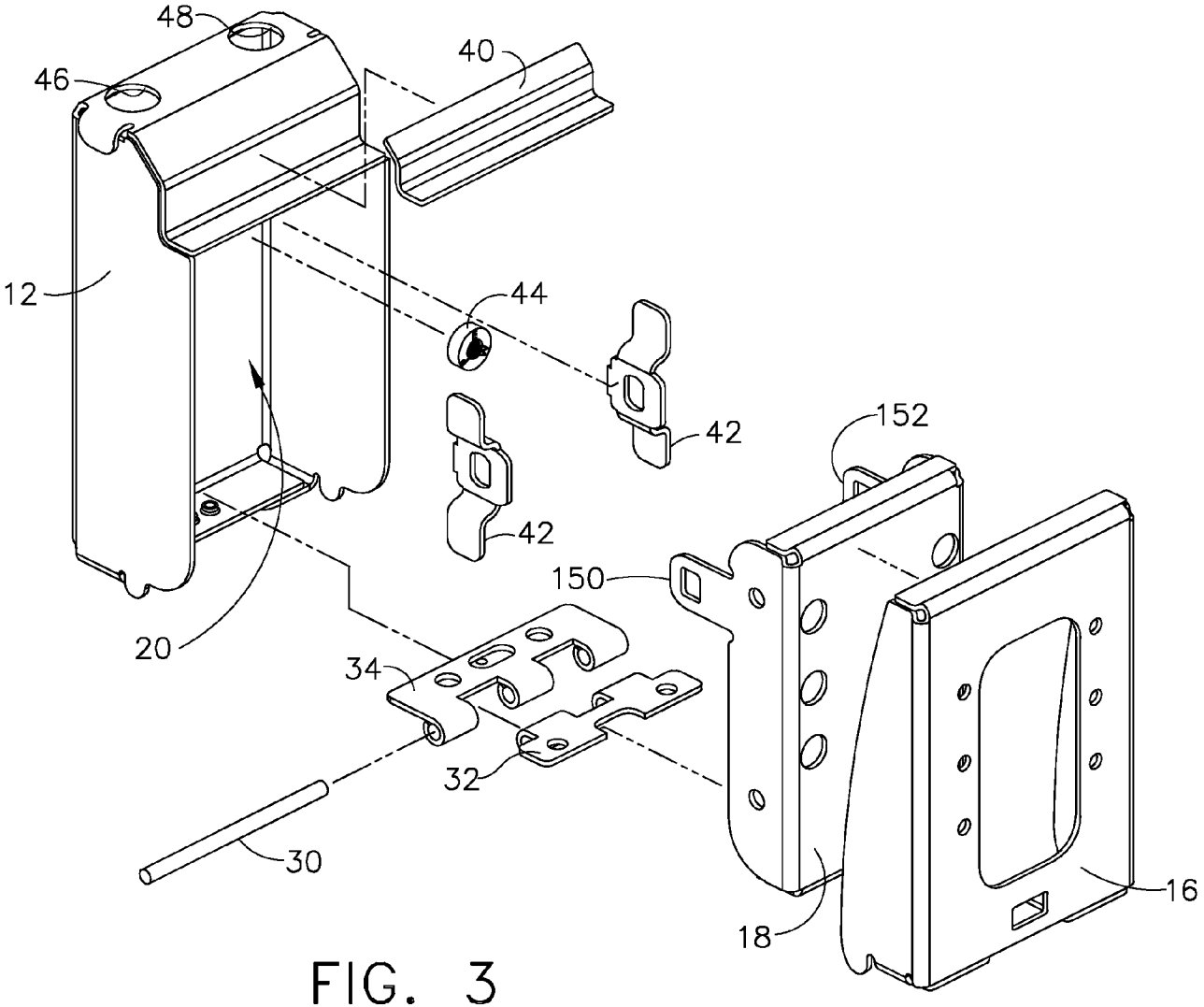
FIG. 3 is an exploded view in perspective of the electronic lock box of FIG. 1.

Referring now to FIG. 3, the enclosure components and other certain components are illustrated in an exploded view. The hinge components 30, 32, and 34 are visible, and the front case can be seen as comprising two separate covers 16 and 18. The key door outer cover is reference numeral 16, while the key door inner cover is reference numeral 18. The use of two separate covers for the key compartment door is to increase the mechanical security of the electronic lock box of the present invention.

Figure 5:
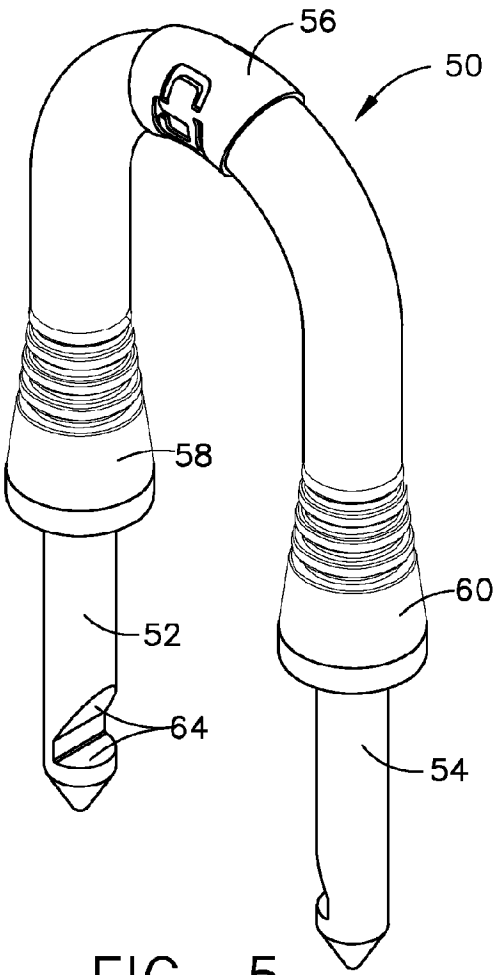
FIG. 5 is a perspective view of the shackle of FIG. 4.
Figure 4:
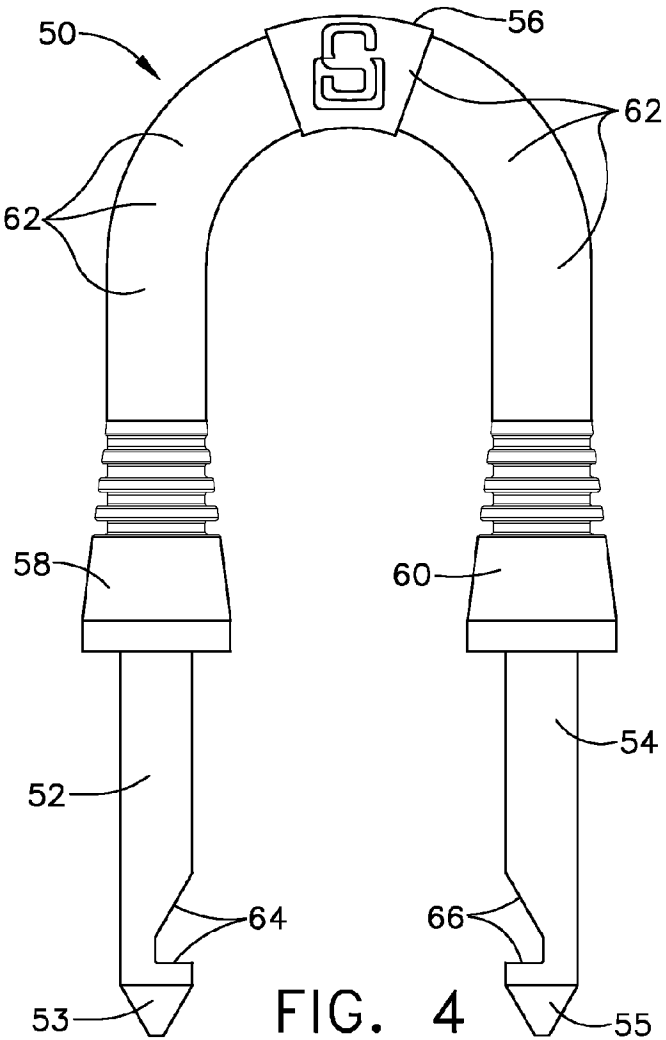
FIG. 4 is a front elevational view of a shackle used with the electronic lock box of FIG. 1.

A cross brace 40 is illustrated in FIG. 3, and its placement on the rear case 12 is depicted on FIG. 1. Also illustrated in FIG. 3 are two side brackets 42 that are mounted into the rear case 12, and there is also a weld nut 44 that is mounted (or welded) to the rear case 12. Referring now to FIGS. 4 and 5, a shackle 50 is illustrated for use with the electronic lock box of the present invention. Shackle 50 has two extensions, a left shackle extension (or barrel) 52 and a right shackle extension (or barrel) 54 (as oriented in these views). The farthest tips (or ends) of the barrels 52 and 54 are angled (in a frusto-conical shape), as depicted at reference numerals 53 and 55, respectively.

In this particular mechanical embodiment of the present invention, the shackle barrels are virtually identical, and have the same length of extension and exhibit the same type of sloped surfaces that make up the latching surfaces. The latching surfaces for the left shackle barrel 52 are depicted at 64, and the shackle latching surfaces for the right shackle barrel 54 are depicted at 66. These shackle surfaces 64 and 66 are also sometimes referred to as first and second "notches," and will be discussed below in greater detail, with respect to the overall mechanical latching design of the present invention.

Shackle 50 has an upper portion 56, and the overall "U" shape of the shackle can be seen as having a conformal cover 62. Part of the conformal cover 62 comprises two rain caps; there is a left shackle rain cap 58 and a right shackle rain cap 60. This helps to prevent water from entering the top openings 46 and 48 of the rear case 12 when the electronic lock box of the present invention is in actual use.

Figure 7:
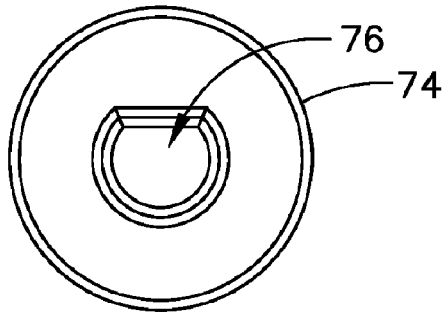
FIG. 7 is a top view of the drive screw of FIG. 6.
Figure 6:
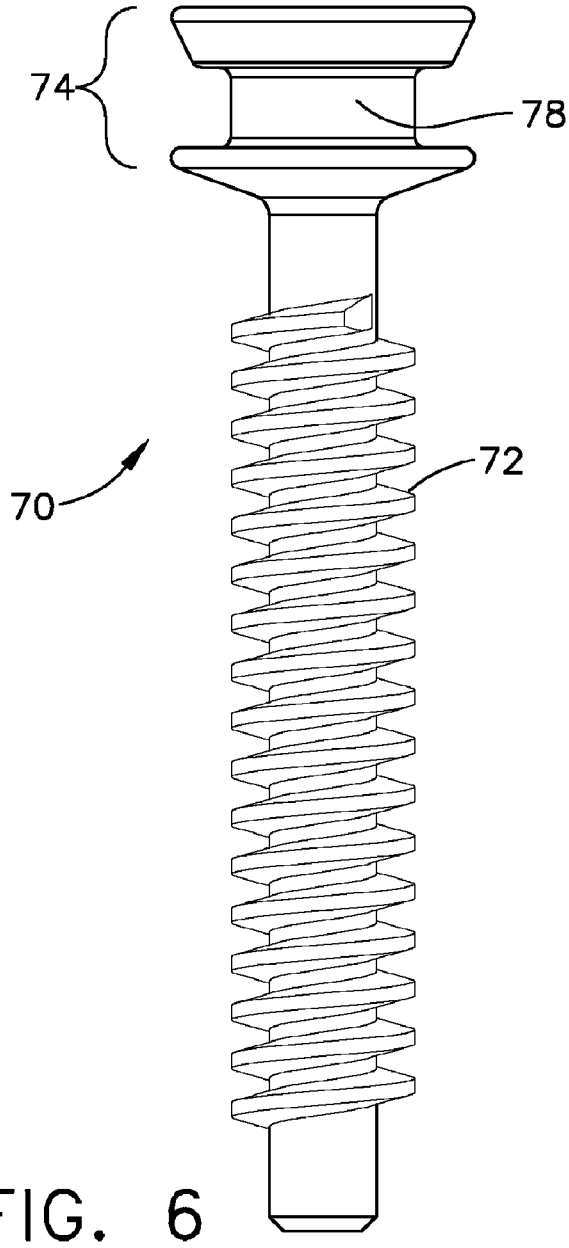
FIG. 6 is an elevational view of a drive screw used with the electronic lock box of FIG. 1.
Figure 9:
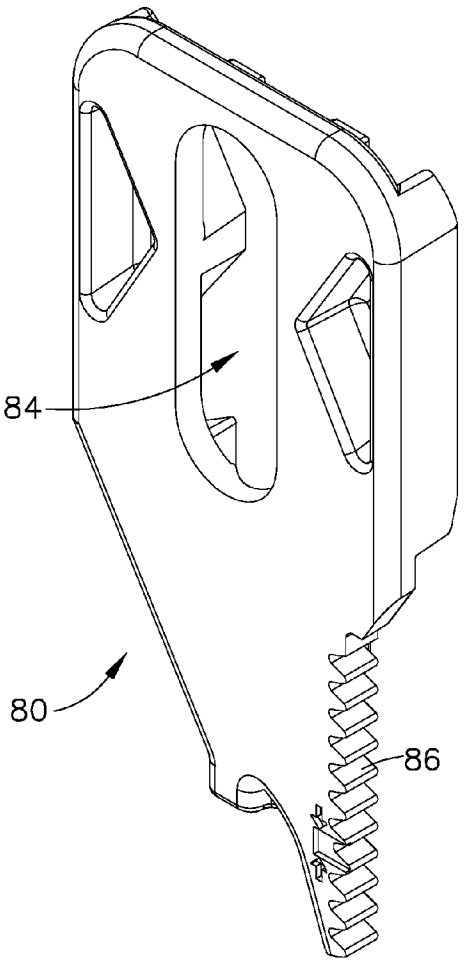
FIG. 9 is a perspective view from the opposite side of the movable actuator of FIG. 8.
Figure 8:
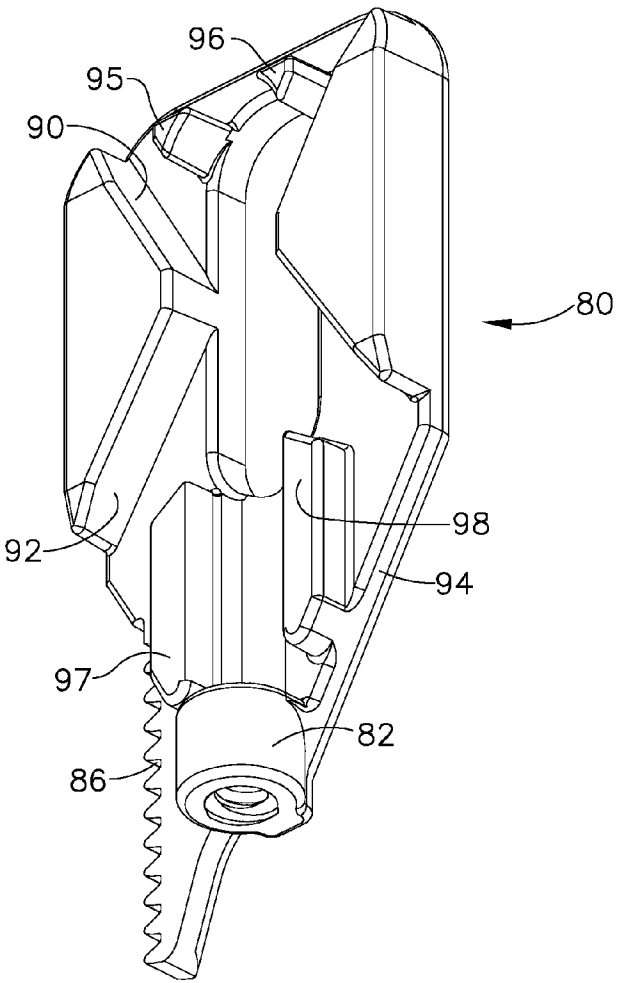
FIG. 8 is a perspective view of a movable actuator that is used in the electronic lock box of FIG. 1.
Figure 14:
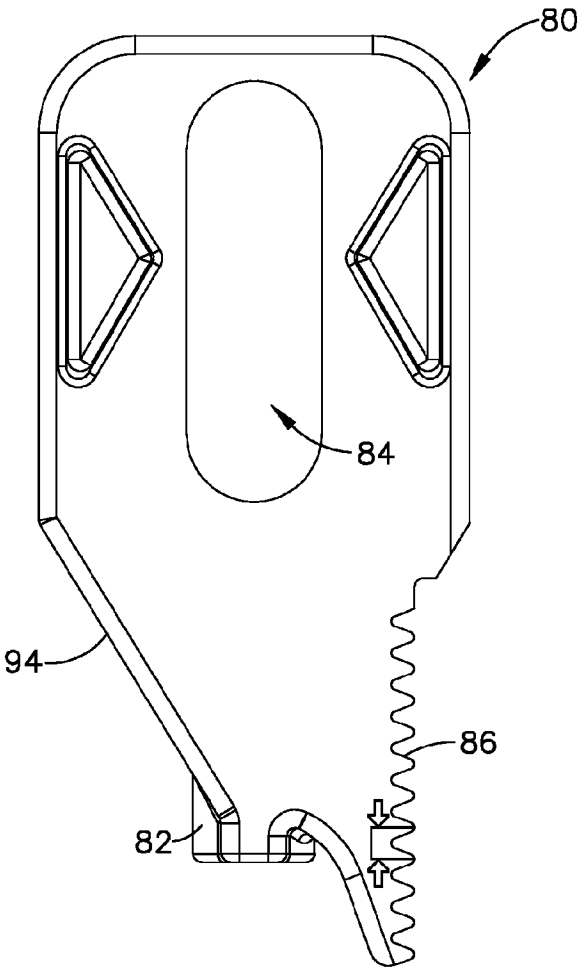
FIG. 14 is a rear elevational view of the movable actuator of FIG. 8.

Referring now to FIGS. 6 and 7, a drive screw 70 is illustrated in some detail. Screw 70 has Acme threads 72, and has a specific type of screw head 74. Screw head 74 has a D-slot at 76 (see FIG. 7). Screw head 74 also has a collar surface at 78. This collar surface 78 will act as a retention collar with respect to the other mechanical devices that will be described below. The drive screw 70 is used to position a movable actuator that will now be described in reference to FIGS. 8-14.

FIGS. 8-14 illustrate in detail a movable actuator, generally designated by the reference numeral 80. On one end of the movable actuator is a nut 82 that has internal Acme threads. These threads will mate with the external threads 72 of the drive screw 70. In the central region of the movable actuator 80 is an oval opening 84, that retains a bushing (not shown in these views). There are linear gear teeth 86 along the bottom portion of one of the sides of the actuator 80.

Figure 13:
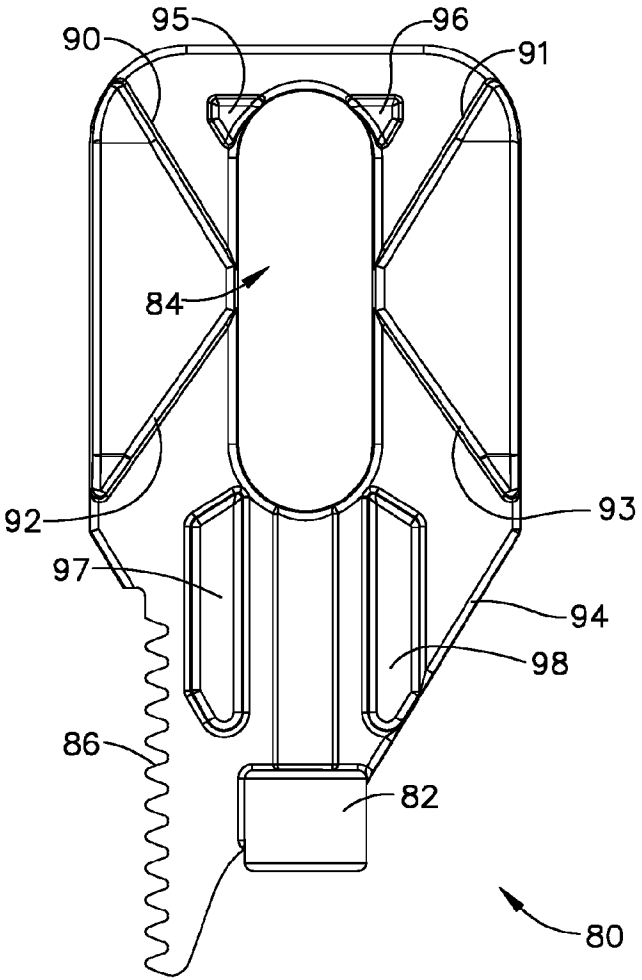
FIG. 13 is a front elevational view of the movable actuator of FIG. 8.

Movable actuator 80 has several sloped guiding surfaces that have the appearance of ramps, designated by reference numerals 90, 91, 92, and 93. These sloped guiding surfaces are best viewed in FIGS. 8, 10, and 13. In FIGS. 10 and 13, the upper left ramp is at 90, the upper right ramp is at 91, the lower left ramp is at 92, and the lower right ramp is at 93. There is also a sloped (or ramped) outer edge 94 that can be seen in FIGS. 8, 10, 13, and 14. Surfaces 90 and 91 are sometimes referred to herein as a "first spaced-apart pair of sloped surfaces;" surfaces 92 and 93 are sometimes referred to herein as a "second spaced-apart pair of sloped surfaces."

As can be seen in the figures, sloped surfaces 90-93 are at angles that are not perpendicular to a longitudinal axis of the movable actuator 80. Furthermore, sloped surfaces 90 and 91 are closer to one another at a central area (near the opening 84 of the actuator 80), and are farther apart from one another at the upper end (a "first end"), on FIG. 10; sloped surfaces 92 and 93 are closer to one another at the central area (near the opening 84 of the actuator 80), and are farther apart from one another at the lower end (a "second end"), on FIG. 10.

Movable actuator 80 also has several blocking wall members, which are designated by the reference numerals 95, 96, 97, and 98. These "blocking members" protrude from one of the surfaces of the movable actuator 80, and this is the surface that faces the viewer on FIGS. 10 and 13. The blocking members can also be seen in the perspective view of FIG. 8. In FIGS. 10 and 13, an upper left blocking member is at 95, and a similar member for the upper right is at 96. A lower left blocking member is at 97, and a similar member is at the lower right at reference numeral 98. Blocking members 95 and 96 are sometimes referred to herein as a "first spaced-apart pair of blocking members;" blocking members 97 and 98 are sometimes referred to herein as a "second spaced-apart pair of blocking members."

The purposes for the shapes and positions of the sloped guiding surfaces (or ramps) 90-93 and the blocking members 95-98 will be explained below. These surfaces and blocking members aid in the greater security of the electronic lock box of the present invention.

Figure 15:
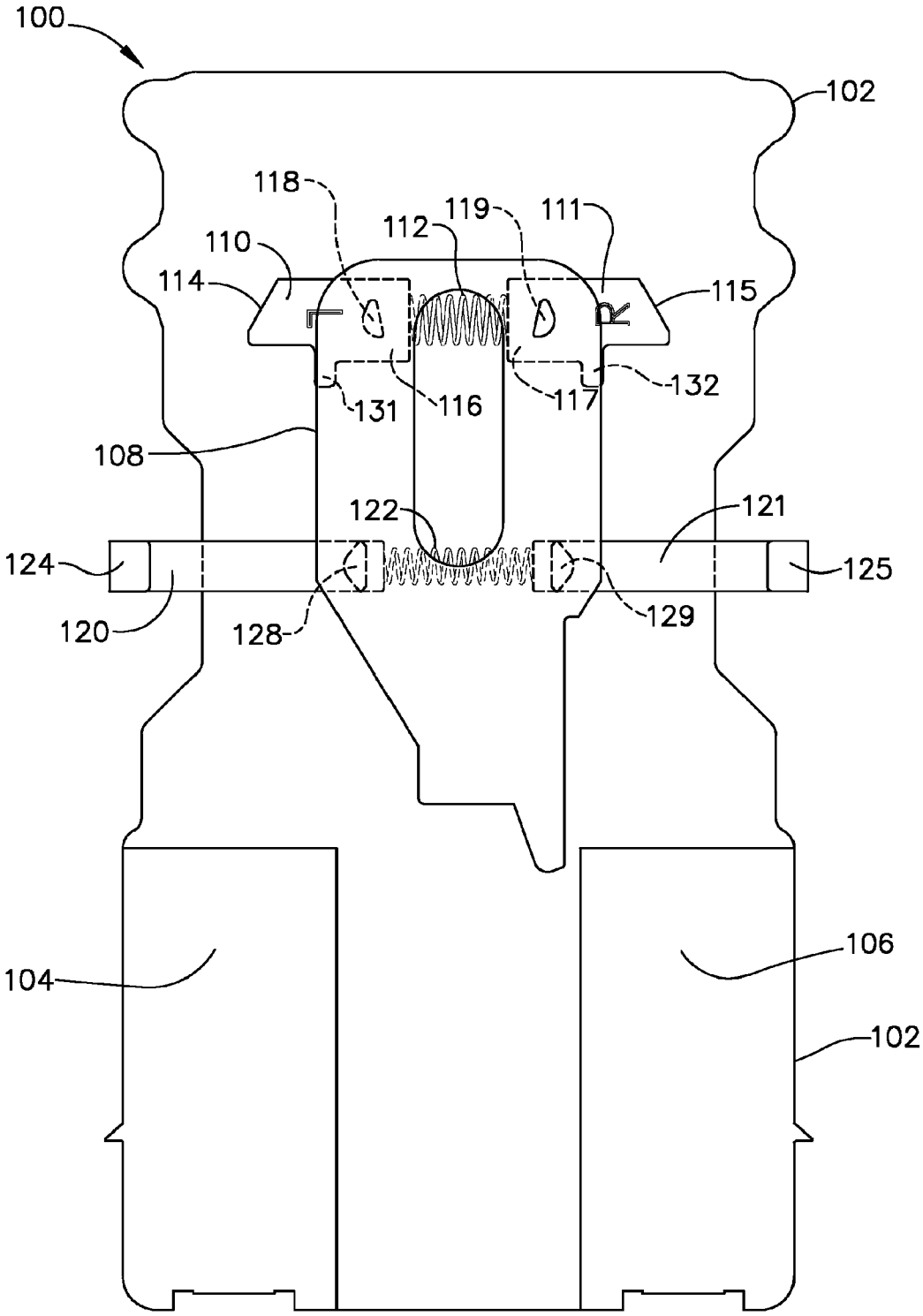
FIG. 15 is a front plan view of a "mechanism box" that is used in the electronic lock box of FIG. 1.

Referring now to FIG. 15, a "mechanism box" is generally depicted by the reference numeral 100, which is a type of housing with the overall enclosure of the electronic lock box 10. Within this so-called mechanism box are several movable components that are important to the latching and locking operations of the present invention. Mechanism box 100 has a perimeter wall 102, and within the perimeter of this wall are two battery wells at 104 and 106. The outline of the movable actuator 80 is depicted on FIG. 15 as a reference point 108 for some of the other components. It will be understood that movable actuator 80 is not fixed at this position 108 that is depicted on FIG. 15, but actually can travel in a substantially linear manner, in the vertical direction with respect to the depiction of FIG. 15.

FIG. 15 illustrates four different control arms 110, 111, 120, and 121, which are illustrated in greater detail on FIGS. 16-22. With respect to FIG. 15, there are two springs 112 and 122 that are in mechanical communication with the control arm 110, 111, and 120, 121. In this view, the spring 112 will be referred to as the "upper spring," and the spring 122 will be referred to as the "lower spring." Spring 112 is also sometimes referred to herein as a "first mechanical bias member," and spring 122 is also sometimes referred to herein as a "second mechanical bias member." It will be understood that other types of mechanical biasing devices could be used in lieu of coil springs, without departing from the principles of the present invention.

As can be seen in FIG. 15, the upper spring 112 is in mechanical communication with the upper control arms 110 and 111 while the lower spring 122 is in mechanical communication with the lower control arms 120 and 121. Spring 112 tends to push the upper control arms 110 and 111 apart from one another, i.e., toward the outer perimeter 102 of the mechanism box. The same is true for the lower spring 122; i.e., it tends to push the lower control arms 120 and 121 apart from one another, toward the outer perimeter 102 of the mechanism box.

For ease of assembly, the upper-left control arm 110 has an "L" depicted on the control arm itself, while the upper-right control arm 111 has an "R" depicted on it. These two control arms 110 and 111 have different shapes, and their orientation is important in this particular embodiment, while the lower control arms 120 and 121 are interchangeable in this embodiment. The upper-left control arm 110 is essentially a mirror image of the upper-right control arm 111.

Figure 16:
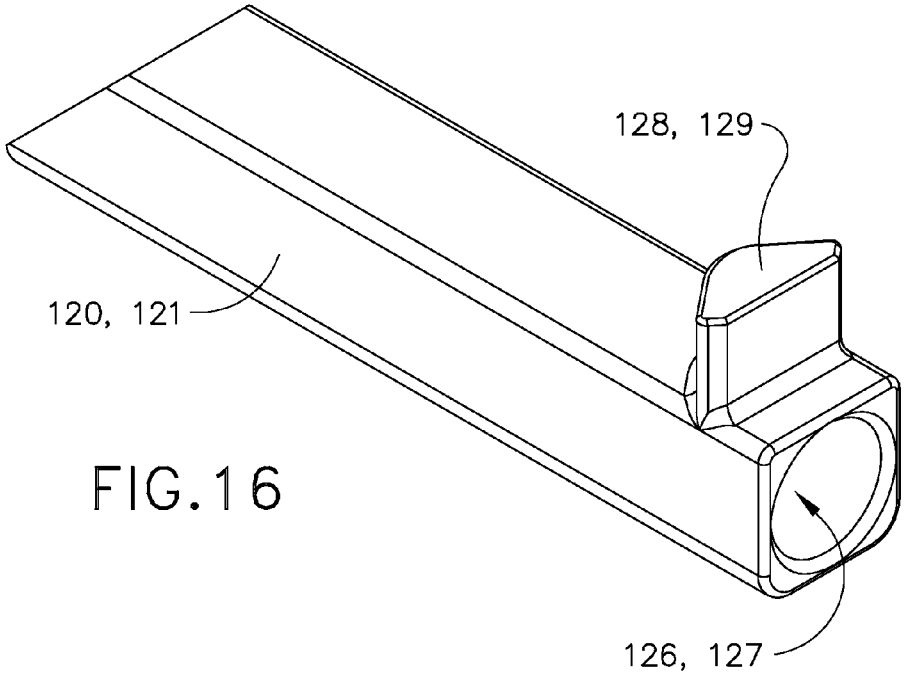
FIG. 16 is a perspective view of a lower control arm used in the lock box of FIG. 1.
Figure 17:
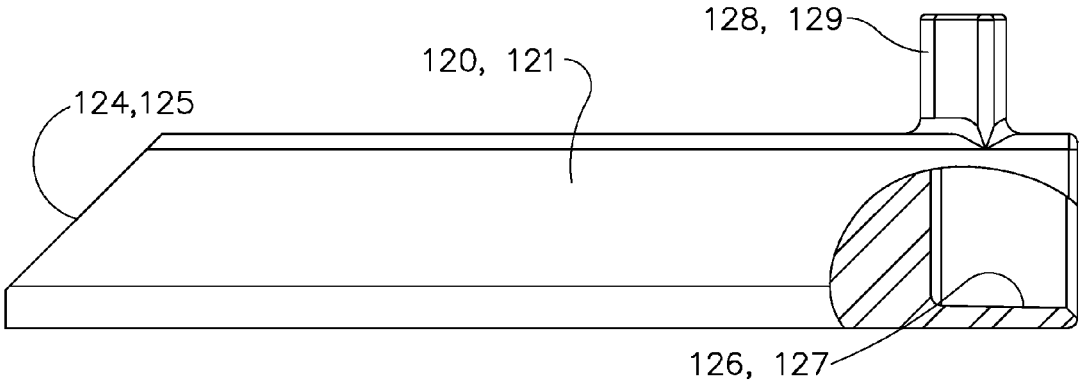
FIG. 17 is a side elevational view of the lower control arm of FIG. 16.
Figure 18:
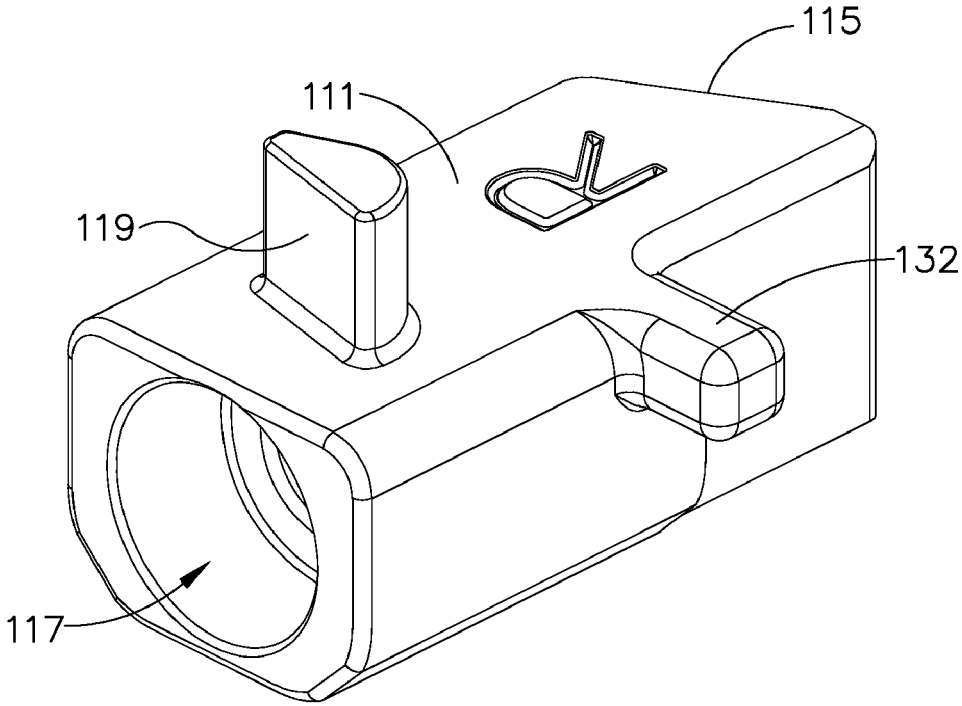
FIG. 18 is a perspective view of an upper control arm used in the lock box of FIG. 10.
Figure 19:
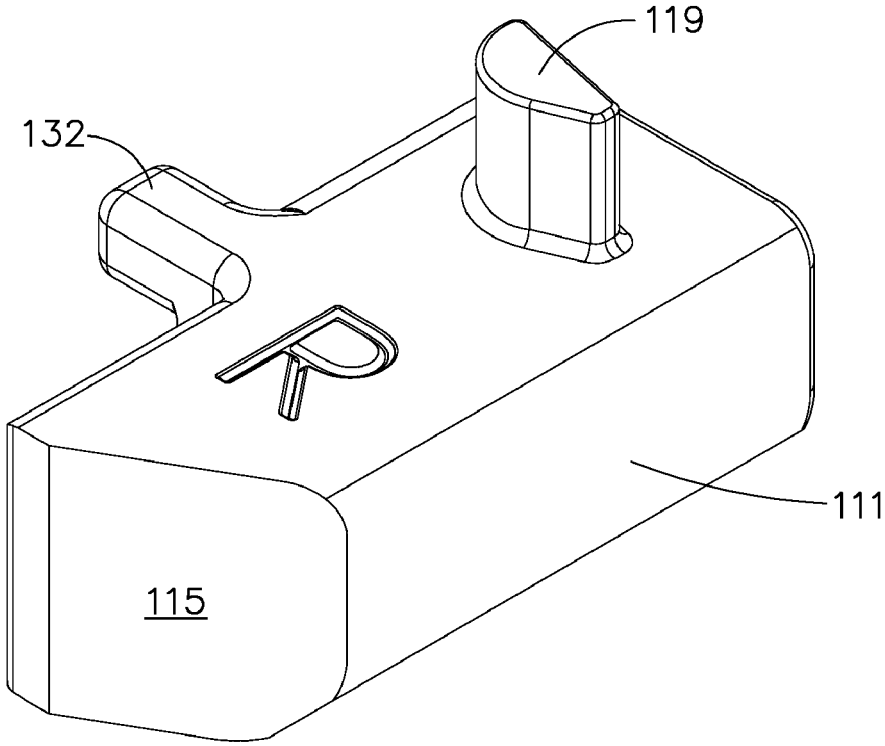
FIG. 19 is a perspective view of the upper control arm of FIG. 18, taken from the opposite direction.

Referring now to FIGS. 16 and 17, one of the lower control arms is depicted, and is designated by the reference numerals 120 and 121. As noted above, these two control arms are interchangeable, and only a single one is illustrated in FIGS. 16 and 17. Control arm 120, 121 has an elongated, somewhat linear shape, and essentially has a square cross-section. There is a sloped control surface 124 or 125, depending on whether this would be the "left" control arm or the "right" control arm 120 or 121, respectively. The function of the sloped control surface 124, 125 will be discussed below. There is an interior opening 126 or 127 (again depending upon which control arm is being discussed), and this receives one of the ends of the lower spring 122. In FIG. 15, lower spring 122 is illustrated as a coil spring, and its outer dimension will fit inside the inner diameter of these two interior openings 126 or 127.

There is a control protrusion 128 or 129 on one of the longitudinal surfaces of the control arm 120 or 121, respectively. In FIGS. 16 and 17, there is a single control protrusion (either 128 or 129) that extends at a right angle from the longitudinal axis of the control arm itself. In addition, the control protrusion 128, 129 is near the opposite end from the sloped control surface 124 or 125. The purpose of the control protrusion 128, 129 will be discussed below.

Referring now to FIGS. 18-22, the upper right control arm 111 is illustrated in great detail. Control arm 111 is also elongated, and has a longitudinal axis with a cross-section that is approximately square, similar to the lower control arms 120 and 121. However, in this embodiment control arm 111 is shorter along its longitudinal axis than the lower control arms 120 and 121. This can be seen by referring to FIG. 15.

Figure 20:
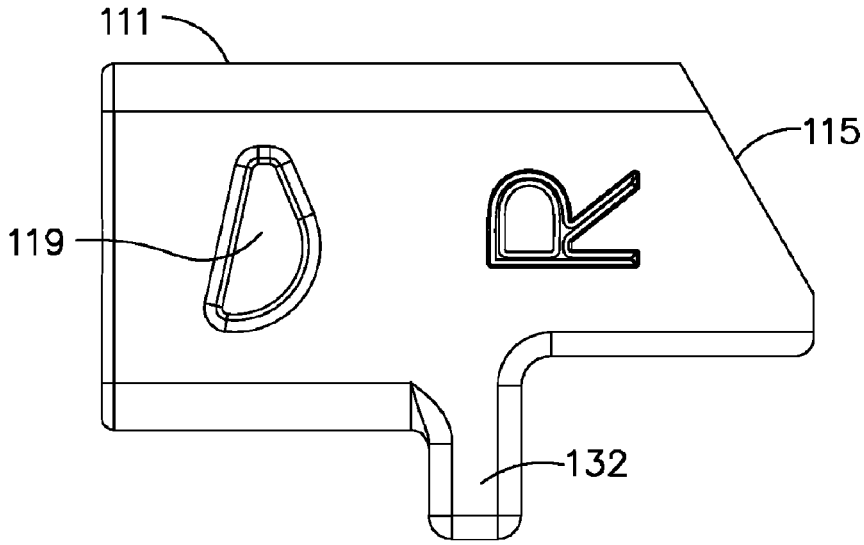
FIG. 20 is a side elevational view of the upper control arm of FIG. 18.
Figure 21:
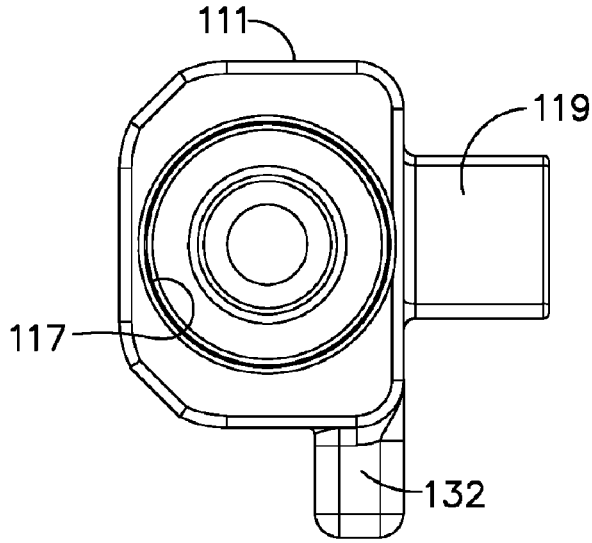
FIG. 21 is an end view of the upper control arm of FIG. 18.
Figure 22:
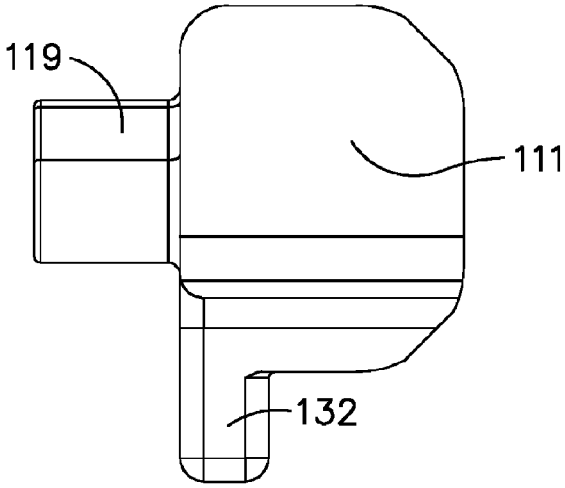
FIG. 22 is an end view taken from the opposite end, of the upper control arm of FIG. 18.

On one end of the control arm 111 is a sloped control surface 115. This is similar to the sloped control surfaces 124 or 125 on the lower control arms, although as can be seen in FIGS. 17 and 20, the angle of the slope is different for the sloped surface 115 compared to the sloped surface 124 or 125. The upper-left control arm 110 has a similar sloped control surface 114, which is visible on FIG. 15.

Control arm 111 has an interior opening on one end, in which the interior opening is designated by the reference numeral 116. This opening 116 is circular, and has an inner diameter that is larger in size than the outer dimension of the upper spring 112. There is a similar interior opening 117 on the upper control arm 110.

There is a control protrusion 119 on the upper-right control arm 111, which can be seen in each of the views of FIGS. 18-22. Control protrusion 119 is located near one of the ends along the longitudinal axis of control arm 111, and it is the opposite end from the sloped control surface 115. This is similar to the lower control arms 120 and 121, with respect to their control protrusions 128 or 129, respectively. The upper-left control arm 110 will have a similar control protrusion 118, which can be seen on FIG. 15. The control protrusion 119 is positioned at a right angle with respect to the longitudinal axis of the control arm 111. For the upper-left control arm 110, the control protrusion 118 is similarly positioned at a right angle with respect to the longitudinal axis of arm 110.

There is a positioning pin 132 that also protrudes at a right angle with respect to the longitudinal axis of the upper-right control arm 111. As can be best seen on FIG. 19, the positioning pin 132 protrudes from a different one of the longitudinal surfaces of the control arm 111. It is still at a right angle with respect to the longitudinal axis, but it is also protruding at a right angle with respect to the axis of the control protrusion 119. There is a similar positioning pin 131 on the upper-right control arm 110, which can be seen on FIG. 15. The positioning pins 131 and 132 assist in preventing the upper control arms 110 and 111 from rotating when they move. The purposes of the control protrusions for the upper control arms 110 and 111 are discussed below.

Referring now to FIGS. 23-26, the orientations of the latching and locking mechanical mechanisms with respect to the shackle and key compartment door mechanisms are illustrated. There are four different possible states for the latching/locking mechanisms, and FIGS. 23, 24, 25, and 26 each show one of those four states.

Control arm 110 is sometimes referred to herein as a "transverse first control arm;" control arm 111 is sometimes referred to herein as a "transverse second control arm;" control arm 120 is sometimes referred to herein as a "transverse third control arm;" and control arm 121 is sometimes referred to herein as a "transverse fourth control arm."

Before discussing the various attributes of the four different mechanical states in FIGS. 23-26, certain other mechanical parts will be introduced. There is a bushing 140 that travels within the oval opening 84 of the movable actuator 80. As can be seen in these views, the axis of the oval opening 84 is vertical, so long as the shackle is also held in a vertical orientation. As the movable actuator 80 is moved through its substantially linear travel, the bushing 140 will hold the movable actuator within a certain range of distances, and will also tend to hold it along the appropriate vertical axis with respect to the remaining portions of the electronic lock box of the present invention.

There is a potentiometer gear 142 that has outer gear teeth or spline that mate with the linear gear teeth 86 of the movable actuator 80. The gear 142 is in mechanical communication with a potentiometer (not shown), so that the physical position of the movable actuator 80 can be measured electrically, and an electrical signal can be produced based on that potentiometer resistance value. This is similar to an earlier version of an electronic lock box that has been sold by assignee, SentriLock LLC.

In FIGS. 23-26, the outer wall of the rear case 12 is depicted by the reference numeral 154. In each of these four views, two portions of this outer wall 154 are depicted, one on each side of the lower control arms 120 and 121 of the locking/latching mechanism. There are also two protruding "ears" 150 and 152 that are illustrated on FIGS. 23-26, and the brackets 42 are further illustrated on FIGS. 23-26. Brackets 42 are also seen on the earlier views of FIGS. 1 and 3.

In the mechanism design of the illustrated embodiment, there are certain important mechanical components, which include the drive screw 70 with an "Acme" style thread (as noted above), a pair of opposable "latches" for the key compartment door (i.e., the "lower" control arms 120 and 121), a pair of opposable "latches" for the shackle (i.e., the "upper" control arms 110 and 111), and the uniquely shaped movable actuator 80.

Drive Screw

As discussed above, the drive screw 80 has a 'D' shaped hole (or slot) 76 on one end. This hole 76 accepts the output shaft of a micro-motor gearbox (not shown). The Acme threads on the drive screw impart a desired rate of linear motion, and minimize frictional losses in the interface between the drive screw 70 and the movable actuator 80. Drive screw 70 incorporates a collar 78, which rides in a journal 88 located in the mechanism box housing. The collar 78 is also retained by a portion of journal 88 that is located in the mechanism box cover. The journal/collar arrangement resists the application of externally induced linear forces on the movable actuator 80 in its desired operating direction unless the drive screw 70 is rotated in the Acme nut 82.

Key Door Latches

The key door latching members are the "lower" control arms 120 and 121, which are mounted opposing each other in a track in the mechanism box 100 housing. These control arms (also referred to as "latches") are extended by a compression spring (lower spring 122) such that the tapered ends of the latches (at sloped control surfaces 124 and 125) extend outside the mechanism box enclosure. Each latch 120, 121 has a protrusion 128, 129 on the top surface (as seen in FIGS. 23-26) that interfaces with the ramped surfaces 92, 93 on the movable actuator 80. As movable actuator 80 travels in a downward direction, the ramped surfaces 92, 93 deflect the key door latches 120, 121, respectively, inward.

The key door components (e.g., the case 14, and inner and outer doors 18 and 16) can be referred to herein as a "first mechanical member" that is to be locked or unlocked, depending on the operating state of lock box 10. When movable actuator is in a "first position" of its travel, the first mechanical member is unlocked. In other travel positions of the movable actuator, the first mechanical member may be locked, as discussed below.

Shackle Latches

Figure 23:
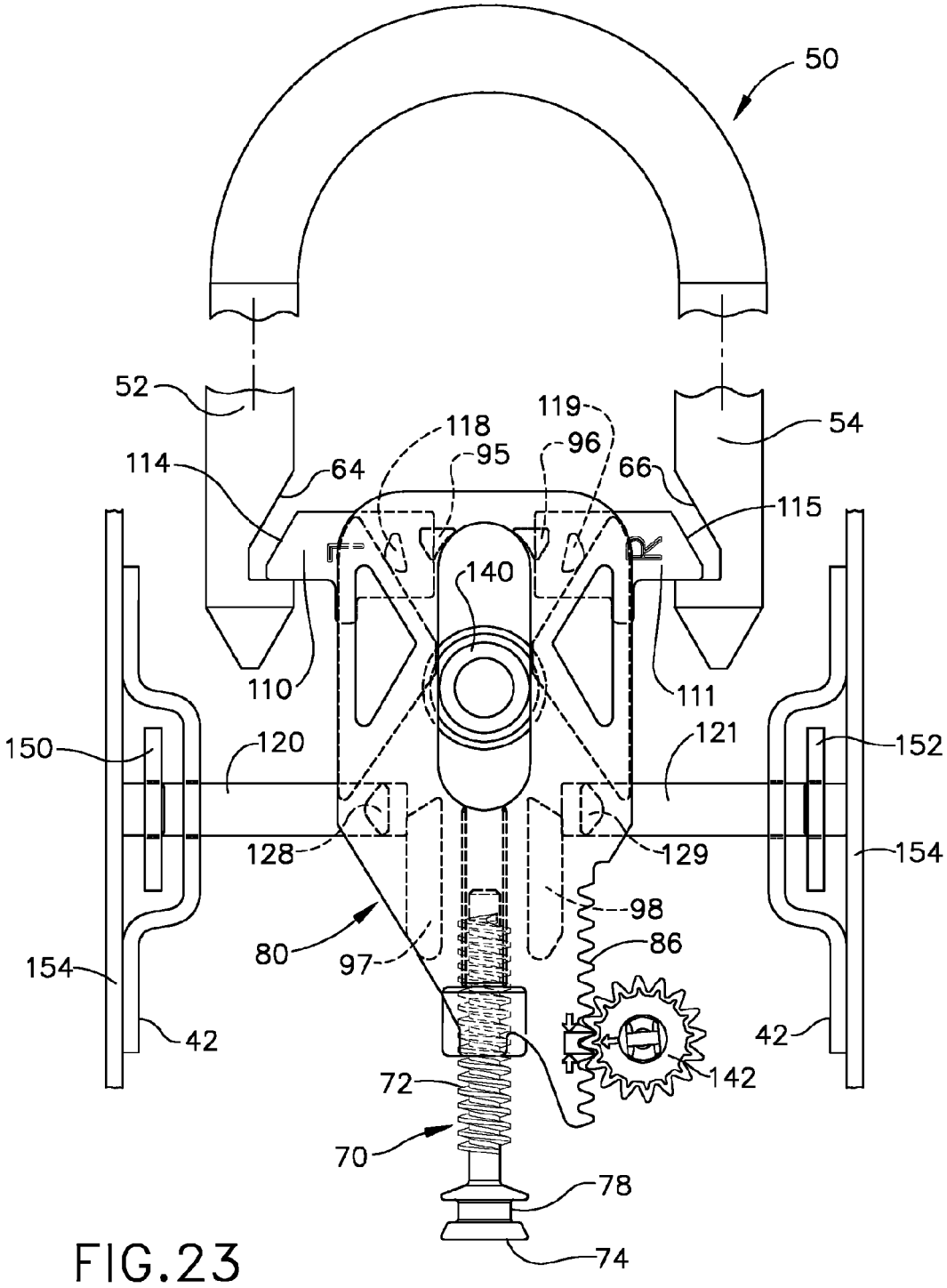
FIG. 23 is a diagrammatic view of certain of the internal components of the electronic lock box of FIG. 1, in which the mechanism components are in a "hard lock" state.

The shackle latching members are the "upper" control arms 110 and 111, which are mounted opposing each other in a track in the mechanism box 100 housing. These control arms (also referred to as "latches") are extended by a compression spring (upper spring 112) such that the angled notched ends of the latches (at angled control surfaces 114 and 115) extend into cylindrical channels (starting at the openings 46 and 48) that the open ends of the shackle barrels (i.e., extensions 52 and 54) slide into. The angled control surfaces 114 and 115 allow the shackle barrels 52 and 54 to deflect upon shackle insertion, while the bottom edges of the control arms 110 and 111 engage the notches 64 or 66 in the shackle barrels, thereby providing interference such that the shackle 50 cannot put pulled out without retracting the shackle latches (i.e., control arms 110 and 111) far enough to clear the notched shackle ends (at 64 and 66). Each control arm 110, 111 has a protrusion on its top surface (as seen in FIG. 23) that interfaces with one of the ramped surfaces 90 or 91 on the movable actuator 80. As movable actuator 80 travels in an upward direction, the ramped surfaces 90, 91 deflect the shackle latches 110, 111 inward.

The shackle (including the barrels 52 and 54) can be referred to herein as a "second mechanical member" that is to be locked or unlocked, depending on the operating state of lock box 10. When movable actuator is in a "second position" of its travel, the second mechanical member is unlocked. In other travel positions of the movable actuator, the second mechanical member may be locked, as discussed below.

Movable Actuator

As seen in FIG. 13, the movable actuator 80 has an oval opening 84 in the middle, two pairs of ramped surfaces 92, 93 on the underside, a threaded "Acme" style nut 82 near its the bottom end, a set of rack teeth 86 on the right face of the lower section, and strategically placed blocking members 97 and 98 on the underside. The rack teeth 86 mesh with the teeth of a spur gear 142 which has a shaft (not shown) that connects into a potentiometer that is utilized in the previously disclosed closed loop feedback position monitoring system. (See U.S. Pat. No. 7,086,258, which is incorporated by reference in its entirety.) The oval opening 84 in the center of movable actuator 80 is used to retain the movable actuator in the mechanism box 100, while also providing guidance to help ensure that movable actuator 80 travels in a substantially straight line. The drive screw 70 retains the bottom end of the movable actuator 80 to assist in providing the desired substantially straight travel.

Key Door Release

To release (or open) the key door (i.e., the inner and outer door covers 16 and 18), power is applied to the micro-motor (not shown) causing the gear box output shaft (not shown) to rotate in a counterclockwise direction, thereby causing the Acme nut 82 on the movable actuator 80 to travel toward the micro-motor. (This would be the "down" direction on FIGS. 23-26.)

Figure 25:
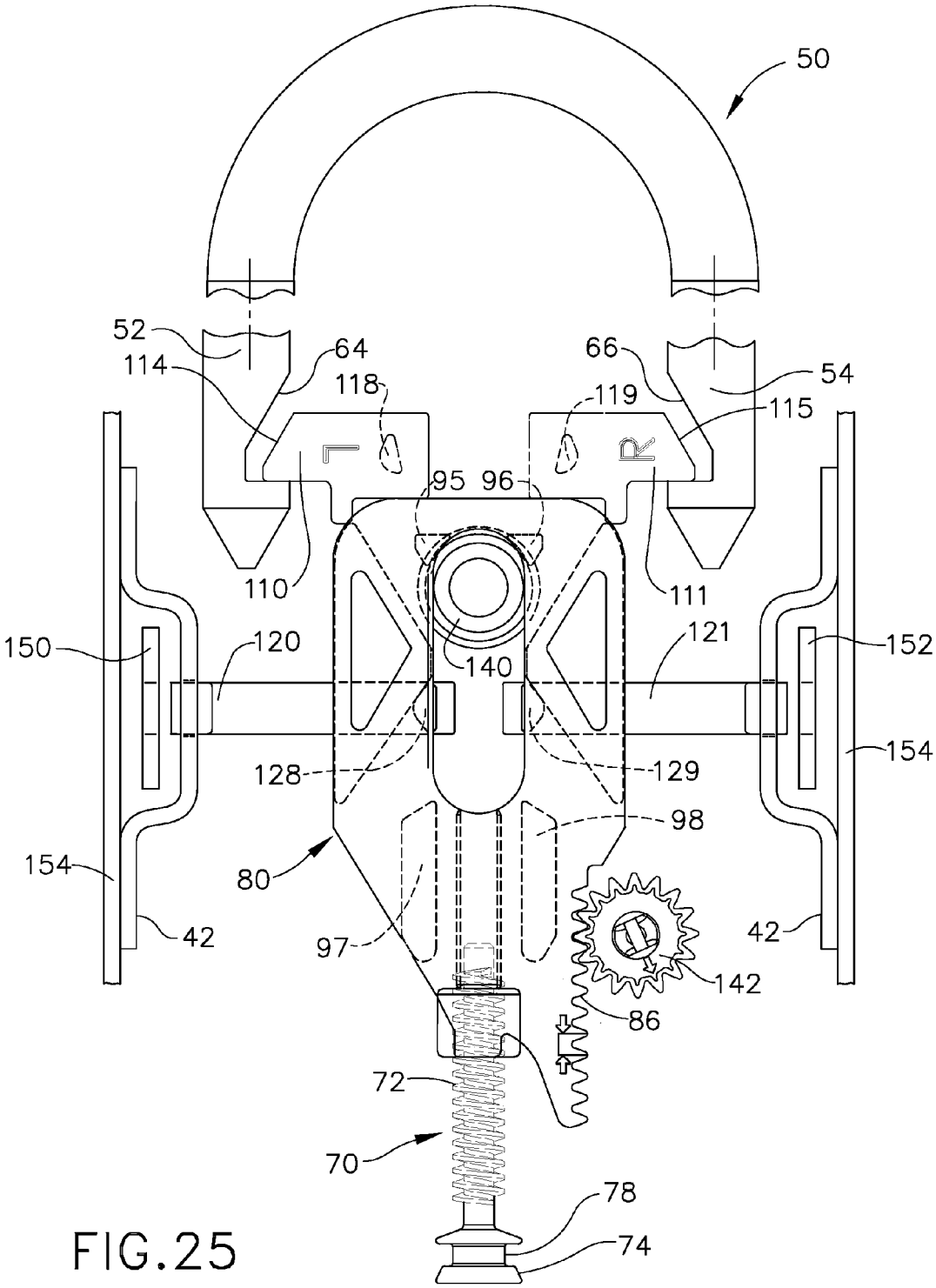
FIG. 25 is a diagrammatic view of certain of the internal components of the electronic lock box of FIG. 1, in which the mechanism components are in a key compartment door unlocking state.

As movable actuator 80 moves toward the motor, the key door latch protrusions (i.e., control arms 120, 121) engage the lower ramped surfaces 92, 93, causing the key door latches 120, 121 to move inward at right angles to the movable actuator motion. When sufficient latch retraction occurs, the ends of the latches (at the sloped control surfaces 124 and 125) no longer interfere with the key compartment door catching members (or "ears") 150 and 152, thus allowing the door ears 150, 152 to pass by the latches 120, 121 and thereby allowing the key compartment to be opened (i.e., the front case 14 will be allowed to pivot with respect to the rear case 12). This operating state is illustrated by FIG. 25 (showing the second position of travel of the movable actuator).

In the illustrated embodiment of the present invention, the movable actuator 80 is moved to its lowermost travel position for door release, which can also be referred to as a "first end travel position." It will be understood that the present invention is not limited to this precise travel position of the movable actuator 80, and other configurations could be used without departing from the principles of the present invention.

Shackle Release

Figure 26:
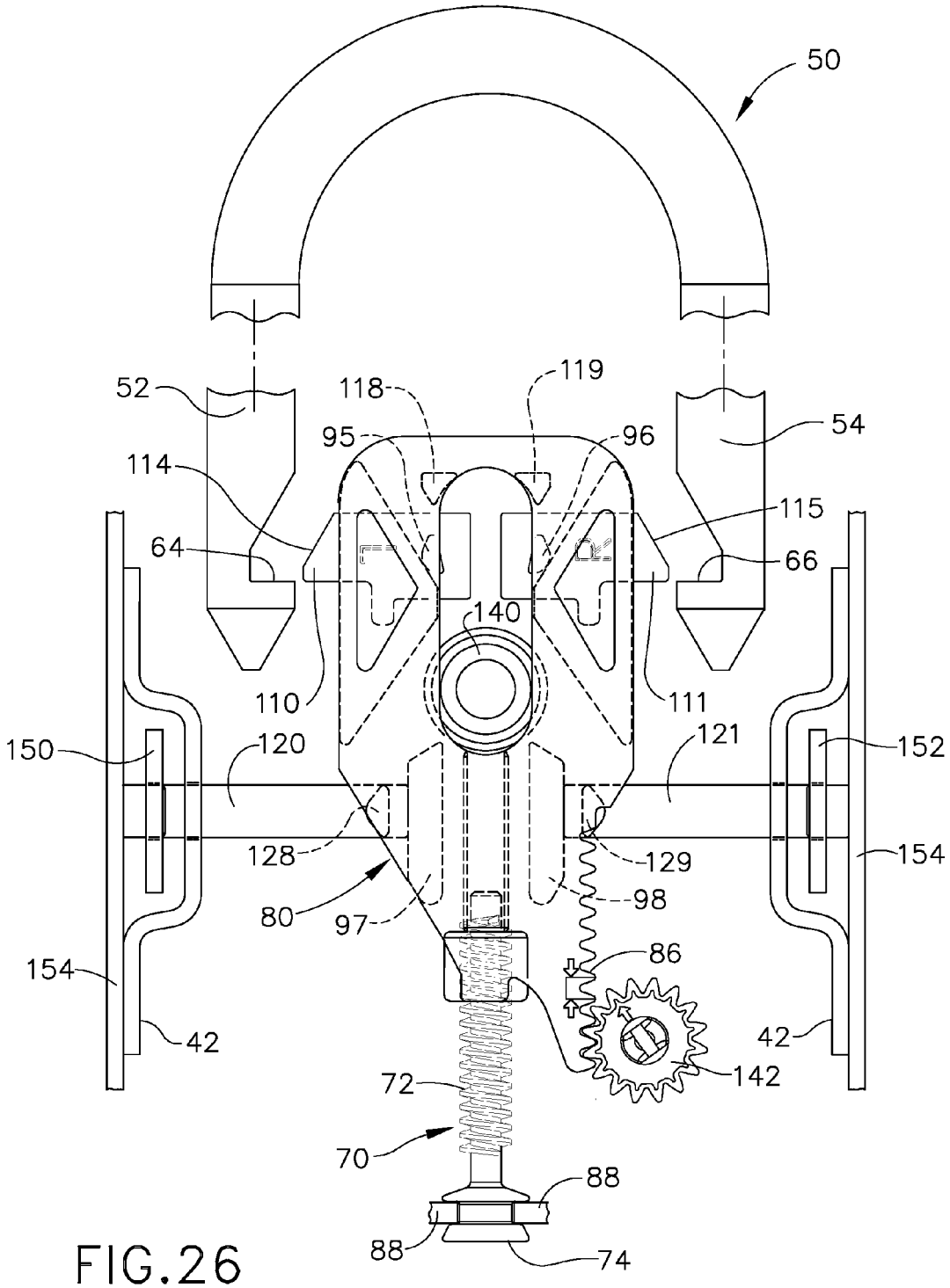
FIG. 26 is a diagrammatic view of certain of the internal components of the electronic lock box of FIG. 1, in which the mechanism components are in a shackle release state.

To release the shackle 50, power is applied to the micro-motor (not shown) causing the gear box output shaft (not shown) to rotate in a clockwise direction, thereby causing the Acme nut 82 on movable actuator 80 to travel away from the micro-motor. (This would be the "up" direction on FIGS. 23-26.) As movable actuator 80 moves away from the motor, the shackle latch protrusions (i.e., the sloped control surfaces 114 and 115 of control arms 110, 111) engage the upper ramped surfaces 90 and 91, causing the shackle latches 110, 111 to move inward at right angles to the movable actuator motion. When sufficient retraction of control arms 110 and 111 occurs, the ends 114, 115 of the shackle latches 110, 111 no longer interfere with the notches 64, 66 in the shackle ends (at shackle extension 52, 54), thus allowing the shackle 50 to be pulled out of the mechanism 10. This operating state is illustrated by FIG. 26 (showing the first position of travel of the movable actuator).

In the illustrated embodiment of the present invention, the movable actuator 80 is moved to its uppermost travel position for shackle release, which can also be referred to as a "second end travel position." It will be understood that the present invention is not limited to this precise travel position of the movable actuator 80, and other configurations could be used without departing from the principles of the present invention.

Soft Lock

Figure 24:
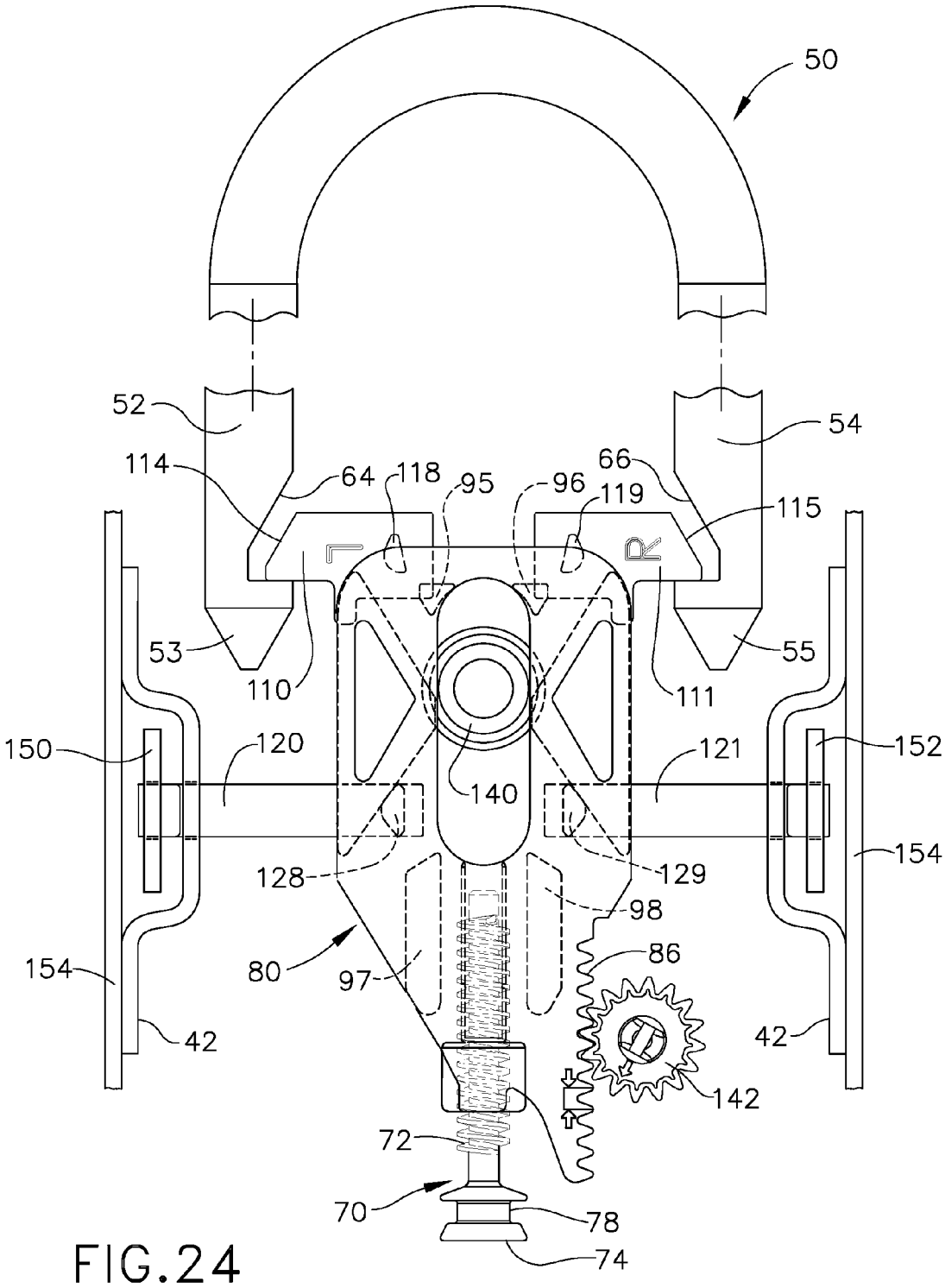
FIG. 24 is a diagrammatic view of certain of the internal components of the electronic lock box of FIG. 1, in which the mechanism components are in a "soft lock" state.

Returning the control arms (or "latches") 110, 111, 120, 121 to a state in which the key compartment door 16, 18 can be latched closed, or the shackle 50 can be inserted into the lock box 10, is performed by applying power to the micro-motor such that its output shaft (not shown) rotates in a direction so as to move the movable actuator 80 in a direction conducive to allowing the compression springs 112 and 122 to extend the latches 110, 111, 120, 121 back to their normal resting position. On FIGS. 23-26, this means that the movable actuator 80 is to be moved to a travel location that is near its bottommost position, and this orientation is illustrated by FIG. 24. Upon reaching this travel location (of FIG. 24), the spring tension exerted by the compression springs 112 and 122 between the pairs of control arms (arms 110, 111 for spring 112, and arms 120, 121 for spring 122) causes the control arms to extend as permitted by the ramp/latch protrusion interface.

The actuator's substantially linear travel is stopped by terminating power to the micro-motor. The appropriate travel location is referred to as the "soft lock" state, and in this state the control arms can be compressed by outside forces, such as by inserting the shackle 50 or by closing the key compartment door 16, 18. However, the "lower" control arms 120 and 121 cannot be compressed so far as to cause the key compartment door latching protrusions at 124 and 125 to be blocked by the blocking members 97 and 98, found on the movable actuator 80. Instead, this state of "soft lock" allows the key compartment door 16, 18 to be closed and latched to a sufficient extent such that it does not fall open.

In the soft lock state, the third and fourth control protrusions 128 and 129 make contact with the third and fourth sloped surfaces 92 and 93, respectively, and the third and fourth control arms 120 and 121 are retracted to a slight extent. As such, the sloped "third tip" and "fourth tip" 124, 125 of third and fourth control arms 120 and 121 can "slide" by the openings 160 and 162 in the catching members 150 and 152, respectively. But once the control arms have reached these openings 160 and 162, then the mechanical bias (due to the action of spring 122) will force control arms 120 and 121 outward, and their tips (ends) 124 and 125 will occupy the openings 160 and 162, and the key compartment door 16, 18 will not be able to re-open. This operating state is illustrated by FIG. 24.

In a similar manner, the "upper" control arms 110 and 111 cannot be compressed so far as to cause the shackle latching protrusions at 114 and 115 to be blocked by the blocking members 95 and 96, found on the movable actuator 80. Instead, this state of "soft lock" allows the shackle 50 to be inserted and latched to a sufficient extent such that it will be retained without falling out. The first and second angled tips 53 and 55 of the shackle barrels 52 and 54, respectively, can slide past the angled surfaces 114 and 115, respectively, at the tips (or ends) of the control arms 110 and 111. But once the control arms have reached the notches 64 and 66, then the mechanical bias (due to the action of spring 112) will force control arms 110 and 111 outward, and their tips (ends) 114, 115 will occupy the open areas of notches 64 and 66, and the shackle barrels 52 and 54 will not be able to be disengaged from the lock box in this state. This operating state is illustrated by FIG. 24 (showing a fourth position of travel of the movable actuator).

The control arms 110, 112, 120, and 121 are, respectively, sometimes referred to herein as a "first control arm," a "second control arm," a "third control arm," or a "fourth control arm." Their outer control surfaces 114, 115, 124, and 125 are, respectively, sometimes referred to herein as a "first angled outer edge," a "second angled outer edge," a "third angled outer edge," or a "fourth angled outer edge."

Hard Lock

The movable actuator 80 can be moved to a position in which the latch protrusions 114, 115, 124, and 125 (of control arms 110, 111, 120, and 121) will contact the corresponding blocking members 95, 96, 97, and 98 if any external action applies compressive force along the "latch axes" of the control arms. (In FIGS. 23-26, the latch axes are essentially horizontal. Of course, if the electronic lock box 10 of the present invention is placed in a different orientation, then the latch axes will vary accordingly, with respect to the vertical or horizontal directions.) In this state, the control arms are said to be "hard locked," in that they cannot be sufficiently moved by an external force such that the key door ears 150, 152 can move past the control arm ends 124, 125; moreover, the shackle latching surfaces 64, 66 cannot move past the control arm ends 114, 115, and thus the shackle cannot be removed from electronic lock box 10. This operating state is illustrated by FIG. 23 (showing a third position of travel of the movable actuator).

By appropriate control over the amount of clearance between the blocking members and their corresponding control protrusions, the control arms simply cannot be forced to move far enough to allow the key compartment door to be opened, or to allow the shackle to be released, at least not without physically damaging the enclosure of the lock box 10 to such an extent that its appearance would be noticeably altered. In this manner, the blocking members and the control protrusions work in pairs: blocking member 95 and control protrusion 118; blocking member 96 and control protrusion 119; blocking member 97 and control protrusion 128; and blocking member 98 and control protrusion 129.

The amounts of clearance for each set of blocking members and their corresponding control protrusions are predetermined distances. As can be seen in FIG. 23, these clearances are very small as compared to the respective distances (or clearances) between these same mechanical members in the other operating states of electronic lock box 10. The sloped "ramp surfaces" 90-93 control the positioning of the control arms, by forcing the control protrusions 118-119 and 128-129 to be at predetermined locations along the longitudinal axes of the corresponding control arms, while the springs 112 and 122 exert an "outward" force on the control arms (and thus, cause all the control arms to extend outward).

It should be noted that the "ramp surfaces" 90-93 do not have to be straight in order to operate effectively with the control protrusions 118, 119, 128, and 129 of the control arms 110, 111, 120, and 121, respectively. In fact, these control surfaces 90-93 could be curved to take advantage of a particular motor load profile, in order to save energy (particularly since the electric motor, which is the prime mover of the movable actuator 80, is energized by a battery in most installations of a lock box).

With regard to the above description of the "hard lock" state, it should be noted that the blocking members 97 and 98 exhibit sloped surfaces along their uppermost edges, as seen on FIG. 23. These upper sloped surfaces can assist in pushing the control arms 120 and 121 outward, to establish a hard lock state when the control arms 120 and 121 are to extend to their outermost positions. In effect, these upper sloped surfaces act as secondary ramps, and can make contact with the control protrusions 128 and 129. This is useful in the event of a slight mis-positioning of the control arms 120, 121, or to overcome any potential additional friction that otherwise might inhibit the lower spring 122 from doing its job (to extend these control arms).

In addition to the above, the retention collar 78 of drive screw 70 is always confined to the mating area of the journal 88. This arrangement resists externally induced forces on the drive screw, including any impact forces along the longitudinal axis of the drive screw itself. In essence, the movable actuator 80 cannot be moved along its "normal" substantially linear pathway except by rotation of the drive screw. Other (external) forces cannot cause the movable actuator to move, unless the amount of external force used is so great that the Acme threads 72 of the drive screw or the mating threads of the Acme nut 82 on the movable actuator become stripped, or they are literally broken. Again, this cannot easily occur, at least not without physically damaging the enclosure of the lock box 10 to such an extent that its appearance would be noticeably altered.

It would typically be desirable for the electronic lock box 10 to enter the "hard lock" state soon after the "soft lock" state was achieved to allow a user to either insert the shackle 50, or to close the key compartment door 16, 18. The system controller of the electronic lock box could be programmed to cause the micro-motor to automatically be actuated after a predetermined time delay, once the soft lock state was achieved, if desired. Or perhaps the timer function would begin operating once the electronic lock box 10 had its key compartment door opened. The system controller would likely be programmed to move the movable actuator 80 to its soft lock position soon after either the door open state was achieved, or the shackle release state was achieved. In other words, the use would thereby only have a limited amount of time to physically open the key compartment door or pull out the shackle, once an appropriate command had been entered to the electronic lock box 10.

Alternatively, a door limit switch could be provided to "notify" the system controller that the key compartment door had been closed by the user, and then the controller could immediately cause the lock box 10 to enter the hard lock state, without waiting for a timer function to occur. A combination of these events could be used to allow the system controller to decide when the lock box 10 should enter the hard lock state. Of course, other types of sensing devices could be used, if desired, to determine whether the lock box 10 was "ready" for entering its hard lock state, without departing from the principles of the present invention. As an example, there could be a "continuity test" circuit for determining whether the shackle 50 was inserted in the lock box 10. If the shackle 50 is made of an electrically conductive material (such as most metals), then the electrical resistance could be measured between the points within the shackle openings, and this information could be used as an input to the system controller. Once the shackle has been re-installed, the system controller could be programmed to immediately move the movable actuator 80 to its hard lock position.

All documents cited in the Background of the Invention and in the Detailed Description of the Invention are, in relevant part, incorporated herein by reference; the citation of any document is not to be construed as an admission that it is prior art with respect to the present invention. Specifically, the following patents and patent applications by the same inventor are incorporated herein by reference in their entirety: U.S. Pat. No. 6,989,732, issued on Jan. 24, 2006, titled: "ELECTRONIC LOCK SYSTEM AND METHOD FOR ITS USE WITH CARD ONLY MODE;" U.S. Pat. No. 7,009,489, issued on Mar. 7, 2006, titled: "ELECTRONIC LOCK SYSTEM AND METHOD FOR ITS USE;" U.S. Pat. No. 7,086,258, issued on Aug. 8, 2006, titled: "ELECTRONIC LOCK BOX WITH SINGLE LINEAR ACTUATOR OPERATING TWO DIFFERENT LATCHING MECHANISMS;" U.S. Pat. No. 7,193,503, issued on Mar. 20, 2007, titled: "ELECTRONIC LOCK SYSTEM AND METHOD FOR ITS USE WITH A SECURE MEMORY CARD;" U.S. patent application Ser. No. 10/805,018, filed on Mar. 19, 2004, for ELECTRONIC LOCK BOX WITH MULTIPLE MODES AND SECURITY STATES; U.S. patent application Ser. No. 11/585,038, filed on Oct. 23, 2006, for ELECTRONIC LOCK BOX USING A BIOMETRIC IDENTIFICATION DEVICE; and U.S. patent application Ser. No. 11/584,940, filed on Oct. 23, 2006, for ELECTRONIC LOCK BOX WITH KEY PRESENCE SENSING.

The foregoing description of a preferred embodiment of the invention has been presented for purposes of illustration and description. It is not intended to be exhaustive or to limit the invention to the precise form disclosed, and the present invention may be further modified within the spirit and scope of this disclosure. Any examples described or illustrated herein are intended as non-limiting examples, and many modifications or variations of the examples, or of the preferred embodiment(s), are possible in light of the above teachings, without departing from the spirit and scope of the present invention. The embodiment(s) was chosen and described in order to illustrate the principles of the invention and its practical application to thereby enable one of ordinary skill in the art to utilize the invention in various embodiments and with various modifications as are suited to particular uses contemplated. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A locking apparatus, comprising:

(a) a movable actuator that travels in a substantially linear direction between a first end travel position and a second end travel position, said movable actuator having a first end and a second end and a central area therebetween, and said movable actuator having a longitudinal axis which runs between said first and second ends;

(i) said movable actuator having a first spaced-apart pair of sloped surfaces that, proximal to said first end, are farther apart from one another, and that, at said central area, are closer to one another, wherein said first pair of sloped surfaces are at angles that are not perpendicular to said longitudinal axis;

(ii) said movable actuator having a second spaced-apart pair of sloped surfaces that, proximal to said second end, are farther apart from one another, and that, at said central area, are closer to one another, wherein said second pair of sloped surfaces are at angles that are not perpendicular to said longitudinal axis;

(iii) said movable actuator having a first spaced-apart pair of blocking members that are located proximal to said first end, and which are spaced apart from said first pair of sloped surfaces;

(iv) said movable actuator having a second spaced-apart pair of blocking members that are located proximal to said second end, and which are spaced apart from said second pair of sloped surfaces;

(b) a transverse first control arm that exhibits a first control protrusion, a transverse second control arm that exhibits a second control protrusion, and a first mechanical bias member that tends to push said first and second control arms apart from one another;

(c) a transverse third control arm that exhibits a third control protrusion, a transverse fourth control arm that exhibits a fourth control protrusion, and a second mechanical bias member that tends to push said third and fourth control arms apart from one another;

(d) a housing that holds said first control arm, said second control arm, said third control arm, said fourth control arm, and said movable actuator in their proper physical orientations with respect to one another;

(e) wherein:

(i) when said movable actuator is at a first position of its travel, said first control protrusion and said second control protrusion make contact with said first pair of sloped surfaces which cause the first and second control protrusions to move inward, thereby retracting said first and second control arms, and allowing a first mechanical member to be unlocked;

(ii) when said movable actuator is at a second position of its travel, said third control protrusion and said fourth control protrusion make contact with said second pair of sloped surfaces which cause the third and fourth control protrusions to move inward, thereby retracting said third and fourth control arms, and allowing a second mechanical member to be unlocked;

(iii) when said movable actuator is at a third position of its travel, said first control protrusion and said second control protrusion do not make contact with said first pair of sloped surfaces which allow said first and second control arms to extend outward, and causing said first mechanical member to be locked; and (iv) when said movable actuator is at said third position of its travel, said third control protrusion and said fourth control protrusion do not make contact with said second pair of sloped surfaces which allow said third and fourth control arms to extend outward, and causing said second mechanical member to be locked.

2. The locking apparatus of claim 1, wherein:

(a) when said movable actuator is at said third position of its travel, said first and second control protrusions are each positioned between one of said first pair of sloped surfaces and said first pair of blocking members, thereby preventing said first and second control arms from being moved in said transverse direction more than a first predetermined distance, and thereby creating a "hard lock" state for said first mechanical member; and (b) when said movable actuator is at said third position of its travel, said third and fourth control protrusions are each positioned between one of said second pair of sloped surfaces and said second pair of blocking members, thereby preventing said third and fourth control arms from being moved in said transverse direction more than a second predetermined distance, and thereby creating a "hard lock" state for said second mechanical member.

3. The locking apparatus of claim 2, wherein said hard lock state prevents an outside impact force from unlocking said first mechanical member and said second mechanical member.

4. The locking apparatus of claim 1, wherein:

(a) said first mechanical member comprises a shackle having a first barrel and a second barrel, (i) said first barrel having a first angled tip, and a first notch along a surface of said first barrel, (ii) said second barrel having a second angled tip, and a second notch along a surface of said second barrel;

(b) when said movable actuator is at a fourth position of its travel:

(i) said first control protrusion and said second control protrusion do not make contact with said first pair of sloped surfaces which allow said first and second control arms to extend outward;

(ii) a first angled outer edge of said first control arm allows said first angled tip of said first shackle barrel to slide past said first control arm, until said first notch reaches said first control arm, at which time said first mechanical bias member forces said first angled outer edge to engage said first notch and to prevent said first shackle barrel from being removed; and (iii) a second angled outer edge of said second control arm allows said second angled tip of said second shackle barrel to slide past said second control arm, until said second notch reaches said second control arm, at which time said first mechanical bias member forces said second angled outer edge to engage said second notch and to prevent said second shackle barrel from being removed;

thereby creating a "soft lock" state for said first mechanical member.

5. The locking apparatus of claim 1, wherein:

(a) said second mechanical member comprises a secure compartment door having a first catching member and a second catching member, said first catching member having a first opening that allows a third tip of third control arm to pass therethrough, said second catching member having a second opening that allows a fourth tip of fourth control arm to pass therethrough, said door having an ability to open if said first and second catching members are not engaged with said third and fourth control arms;

(b) when said movable actuator is at a fourth position of its travel:

(i) said third control protrusion and said fourth protrusion make contact with said second pair of sloped surfaces which retract said third and fourth control arms to a slight extent;

(ii) a third angled outer edge of said third control arm allows said first catching member to slide past said third control arm, until said first opening reaches said third control arm, at which time said second mechanical bias member forces said third angled outer edge to engage said first opening and to prevent said first catching member from being disengaged; and (iii) a fourth angled outer edge of said fourth control arm allows said second catching member to slide past said fourth control arm, until said second opening reaches said fourth control arm, at which time said second mechanical bias member forces said fourth angled outer edge to engage said second opening and to prevent said second catching member from being disengaged;

thereby creating a "soft lock" state for said second mechanical member.

6. The locking apparatus of claim 1, wherein said movable actuator includes a nut with internal threads, located at said second end; and further comprising a drive screw having external threads that mate with said nut, wherein said drive screw causes said movable actuator to move in said substantially linear direction between its first end travel position and its second end travel position.

7. The locking apparatus of claim 6, wherein said drive screw has a head that exhibits a collar, and said collar mates with a journal that holds said drive screw in a predetermined position with respect to an outer enclosure.

8. The locking apparatus of claim 6, wherein said central area of the movable actuator includes an oval opening; and further comprising a bushing that causes said movable actuator to move substantially along said longitudinal axis, in conjunction with said drive screw.

9. A lock box apparatus, comprising:

an enclosure; a detachable holding member actuatable by a first movable control arm; a secure compartment within said enclosure, having a movable door actuatable by a second movable control arm; a movable actuator; and a driving member that causes said movable actuator to move along a substantially linear travel pathway between a first end travel position and a second end travel position;

wherein:

(a) said first movable control arm includes a first control protrusion that, in first predetermined conditions, makes contact with a first control surface of said movable actuator;

(b) said second movable control arm includes a second control protrusion, in second predetermined conditions, makes contact with a second control surface of said movable actuator;

(c) said movable actuator includes a first blocking member, which may engage said first control protrusion;

(d) said movable actuator includes a second blocking member, which may engage said second control protrusion;

(e) when moved to a first position along said substantially linear travel pathway, said movable actuator causes said first movable control arm to be actuated, by way of contact between said first control protrusion and said first control surface, so as to release said holding member, thus allowing said lock box apparatus to be detached from a fixed object;

(f) when moved to a second position along said substantially linear travel pathway, said movable actuator causes said second movable control arm to be actuated, by way of contact between said second control protrusion and said second control surface, so as to disengage said door, thus allowing access to said secure compartment by opening said door;

(g) when moved to a third position along said substantially linear travel pathway, said movable actuator causes said first movable control arm to be actuated so as to allow said holding member to be reinstalled to said lock box apparatus, and once said holding member has been reinstalled, said first movable control arm prevents said holding member from falling out from said lock box apparatus, thereby obtaining a "soft lock;"

(h) when moved to said third position along said substantially linear travel pathway, said movable actuator causes said second movable control arm to be actuated so as to allow said door to be closed, and once said door has been closed, said second movable control arm prevents said door from falling open, thereby obtaining a "soft lock;"

(i) when said movable actuator is moved to a fourth position along said substantially linear travel pathway, said first control surface of the movable actuator and said first blocking member substantially hold said first control protrusion within a first predetermined range of movement, and thus prevent said holding member from being detached from said lock box apparatus, thereby obtaining a "hard lock;" and (j) when said movable actuator is moved to said fourth position along said substantially linear travel pathway, said second control surface of the movable actuator and said second blocking member substantially hold said second control protrusion within a second predetermined range of movement, and thus prevent said door from being opened, thereby obtaining a "hard lock".

10. The lock box apparatus of claim 9, wherein:

said movable actuator has a longitudinal axis that is substantially parallel to said linear travel pathway;

said first movable control arm moves in a direction that is substantially perpendicular to said longitudinal axis of the movable actuator; and said second movable control arm moves in a direction that is substantially perpendicular to said longitudinal axis of the movable actuator.

11. The lock box apparatus of claim 10, wherein:

said first movable control arm comprises a first pair of spaced-apart elongated members, with a first spring therebetween that tends to push apart said first pair of spaced-apart elongated members; and said second movable control arm comprises a second pair of spaced-apart elongated members, with a second spring therebetween that tends to push apart said second pair of spaced-apart elongated members.

12. The lock box apparatus of claim 9, wherein:

said first control surface of the movable actuator is sloped at a first angle that is not perpendicular to said substantially linear travel pathway; and said second control surface of the movable actuator is sloped at a second angle that is not perpendicular to said substantially linear travel pathway.

13. The lock box apparatus of claim 9, wherein:

said first control surface of the movable actuator comprises a first pair of sloped surfaces at a first angle that is not perpendicular to said substantially linear travel pathway;

said first movable control arm comprises a first pair of spaced-apart elongated members, with a first spring therebetween that tends to push apart said first pair of spaced-apart elongated members, and in which said first control protrusion comprises a first pair of control protrusions; and when said movable actuator is at said first position, said first pair of control protrusions of the first pair of spaced-apart elongated members makes contact with said first pair of sloped surfaces which causes the first pair of control protrusions to move inward, thereby retracting said first pair elongated members, and allowing said holding member to be detached.

14. The lock box apparatus of claim 9, wherein:

said second control surface of the movable actuator comprises a second pair of sloped surfaces at a second angle that is not perpendicular to said substantially linear travel pathway;

said second movable control arm comprises a second pair of spaced-apart elongated members, with a second spring therebetween that tends to push apart said second pair of spaced-apart elongated members, and in which said second control protrusion comprises a second pair of control protrusions; and when said movable actuator is at said second position, said second pair of control protrusions of the second pair of spaced-apart elongated members makes contact with said second pair of sloped surfaces which causes the second pair of control protrusions to move inward, thereby retracting said second pair elongated members, and allowing said door to be opened.

15. The lock box apparatus of claim 9, wherein:

(a) said first control surface of the movable actuator comprises a first pair of sloped surfaces at a first angle that is not perpendicular to said substantially linear travel pathway;

(b) said first movable control arm comprises a first pair of spaced-apart elongated members, with a first spring therebetween that tends to push apart said first pair of spaced-apart elongated members, and in which said first control protrusion comprises a first pair of control protrusions;

(c) said second control surface of the movable actuator comprises a second pair of sloped surfaces at a second angle that is not perpendicular to said substantially linear travel pathway;

(d) said second movable control arm comprises a second pair of spaced-apart elongated members, with a second spring therebetween that tends to push apart said second pair of spaced-apart elongated members, and in which said second control protrusion comprises a second pair of control protrusions;

(e) said first blocking member comprises a first pair of spaced-apart blocking members;

(f) said second blocking member comprises a second pair of spaced-apart blocking members;

(g) when said movable actuator is at said fourth position, said first pair of control protrusions of the first pair of spaced-apart elongated members are limited in physical movement by said first pair of sloped surfaces and said first pair of blocking members; and (h) when said movable actuator is at said fourth position, said second pair of control protrusions of the second pair of spaced-apart elongated members are limited in physical movement by said second pair of sloped surfaces and said second pair of blocking members;

thereby achieving said "hard lock".

16. The lock box apparatus of claim 9, wherein said detachable holding member comprises a shackle having two extension barrels that are inserted into openings in said enclosure.

17. A method for using a lock box, said method comprising:

(a) providing a lock box apparatus that includes an enclosure; a detachable shackle actuatable by a first movable control arm; a secure compartment within said enclosure, having a movable door actuatable by a second movable control arm; a movable actuator having first and second control surfaces; and a driving member that causes said movable actuator to move along a substantially linear travel pathway between a first end travel position and a second end travel position;

(b) driving said movable actuator to a first predetermined position such that said first control surface of the movable actuator causes movement of said first movable control arm so as to release said shackle;

(c) driving said movable actuator to a second predetermined position such that said second control surface of the movable actuator causes movement of said second movable control arm so as to allow said door to be opened;

(d) driving said movable actuator to a third predetermined position creating a "soft lock" state, such that:

(i) said first movable control arm is positioned to allow said shackle to be reinstalled, and to prevent said shackle from falling out from said enclosure, and (ii) said second movable control arm is positioned to allow said door to be closed, and to prevent said door from being reopened; and (e) driving said movable actuator to a fourth predetermined position creating a "hard lock" state, such that:

(i) said first control surface of said movable actuator and a first blocking member of said movable actuator combine to limit movement of said first movable control arm, such that said shackle cannot be released, and (ii) said second control surface of said movable actuator and a second blocking member of said movable actuator combine to limit movement of said second movable control arm, such that said door cannot be opened.

18. The method of claim 17, further comprising the steps of:

mechanically biasing said first movable control arm to push it outward from a central area of said movable actuator; and mechanically biasing said second movable control arm to push it outward from said central area of said movable actuator.

19. The method of claim 17, further comprising the steps of:

providing first mating threads on said driving member, and providing second mating threads on a nut of said movable actuator; and rotating said driving member so said first mating threads cause said movable actuator to travel in a substantially linear direction along said substantially linear travel pathway.

20. The method of claim 19, wherein:

(a) said first and second control surfaces are sloped at angles that are not substantially perpendicular to said substantially linear direction;

(b) said first and second movable control arms are movable in a direction that is substantially perpendicular to said substantially linear direction; and (c) said "hard lock" state tends to prevent vibration and external forces impacting said lock box enclosure from allowing said shackle to be released and from allowing said door to be opened, since (i) forces substantially perpendicular to said substantially linear direction cannot force said first movable control arm to a position in which said shackle is released because of the limited possible movement caused by said first control surface and said first blocking member of the movable actuator, (ii) forces substantially perpendicular to said substantially linear direction cannot force said second movable control arm to a position in which said door is opened because of the limited possible movement caused by said second control surface and said second blocking member of the movable actuator, and (iii) forces substantially parallel to said substantially linear direction cannot force said movable actuator to change position because said movable actuator only moves due to rotation of said first mating threads of the driving member.

* * * * *